US008794682B2

(12) United States Patent
Fiedler

(10) Patent No.: US 8,794,682 B2
(45) Date of Patent: Aug. 5, 2014

(54) CLOSURE DEVICE FOR CONNECTING TWO PARTS

(75) Inventor: Joachim Fiedler, Hannover (DE)

(73) Assignee: Fidlock GmbH, Hannover (DE)

( * ) Notice: Subject to any disclaimer, the term of this patent is extended or adjusted under 35 U.S.C. 154(b) by 20 days.

(21) Appl. No.: 13/145,609

(22) PCT Filed: Jan. 25, 2010

(86) PCT No.: PCT/EP2010/050805

§ 371 (c)(1),
(2), (4) Date: Aug. 24, 2011

(87) PCT Pub. No.: WO2010/084191

PCT Pub. Date: Jul. 29, 2010

(65) Prior Publication Data

US 2011/0298227 A1 Dec. 8, 2011

(30) Foreign Application Priority Data

Jan. 23, 2009 (DE) ..... 10 2009 006 003
Jan. 31, 2009 (DE) ..... 10 2009 007 016

(51) Int. Cl.

| | |
|---|---|
| ***E05C 17/56*** | (2006.01) |
| ***E05C 19/16*** | (2006.01) |
| *A44B 1/04* | (2006.01) |
| *A44B 11/25* | (2006.01) |
| *A44B 17/00* | (2006.01) |

(52) U.S. Cl.
USPC ..... 292/251.5; 24/303

(58) Field of Classification Search
CPC ..... H01F 7/0263; H01F 7/02; A41F 1/00; E05C 19/16; E05B 47/004
USPC ..... 292/251.5, 318, 340, 80, 10; 24/303
See application file for complete search history.

(56) References Cited

U.S. PATENT DOCUMENTS

| | | | | | |
|---|---|---|---|---|---|
| 4,480,361 | A | * | 11/1984 | Morita | 24/303 |
| 4,991,270 | A | * | 2/1991 | Aoki | 24/303 |
| 5,377,392 | A | * | 1/1995 | Morita | 24/303 |
| 5,920,966 | A | * | 7/1999 | Chen | 24/303 |
| 5,933,926 | A | * | 8/1999 | Reiter | 24/303 |
| 5,983,464 | A | * | 11/1999 | Bauer | 24/303 |
| 6,009,601 | A | * | 1/2000 | Kaufman | 24/303 |
| 6,131,247 | A | * | 10/2000 | Morita | 24/303 |

(Continued)

FOREIGN PATENT DOCUMENTS

| | | |
|---|---|---|
| WO | 2008006357 A2 | 1/2008 |
| WO | 2009092368 A2 | 7/2009 |
| WO | 2010006594 A2 | 1/2010 |

*Primary Examiner* — Kristina Fulton
*Assistant Examiner* — Faria Ahmad
(74) *Attorney, Agent, or Firm* — The Webb Law Firm

(57) ABSTRACT

A closure device for connecting two parts includes a first connecting module and a second connecting module. The first connecting module can be arranged on the second connecting module in a closing direction and is mechanically latched with the second connecting module in a closed position. The device also includes magnetic means which cause a magnetic attraction force between the first connecting module and the second connecting module to support the transfer of the first connecting module into the closed position. The first connecting module can be released from the second connecting module by means of a movement of the first connecting module or a part of the first connecting module in an opening direction that differs from the closing direction. The magnetic means counteract a movement of the first connecting module in the opening direction.

18 Claims, 23 Drawing Sheets

(56) References Cited

U.S. PATENT DOCUMENTS

| | | | | |
|---|---|---|---|---|
| 6,182,336 | B1 * | 2/2001 | Bauer | 24/303 |
| 6,215,381 | B1 * | 4/2001 | Aoki | 335/207 |
| 6,295,702 | B1 * | 10/2001 | Bauer | 24/303 |
| 6,477,749 | B1 * | 11/2002 | Reiter | 24/303 |
| 6,564,434 | B1 * | 5/2003 | Morita | 24/303 |
| 6,658,697 | B2 * | 12/2003 | Liao | 16/82 |
| 6,929,291 | B2 * | 8/2005 | Chen | 292/251.5 |
| 6,978,521 | B2 * | 12/2005 | Morita | 24/303 |
| 7,367,596 | B2 * | 5/2008 | Leung | 292/281 |
| 2003/0229974 | A1 | 12/2003 | Zemer et al. | |
| 2005/0023841 | A1 * | 2/2005 | Chen | 292/251.5 |
| 2010/0283269 | A1 | 11/2010 | Fiedler | |
| 2010/0308605 | A1 | 12/2010 | Fiedler | |
| 2011/0138583 | A1 | 6/2011 | Fiedler | |

* cited by examiner

CLOSURE DEVICE FOR CONNECTING TWO PARTS

CROSS-REFERENCE TO A RELATED APPLICATION

This application is a National Phase Patent Application of International Patent Application Number PCT/EP2010/050805, filed on Jan. 25, 2010, which claims priority of German Patent Application Number 10 2009 006 003.0, filed on Jan. 23, 2009 and German Patent Application Number 10 2009 007 016.8, filed on Jan. 31, 2009. The disclosures of which are incorporated herein in their entireties by reference.

BACKGROUND OF THE INVENTION

The invention relates to a closure device connecting two parts.

Such a closure device has a first connecting module and a second connecting module, which can be arranged on each other in a closing direction and are mechanically latched to each other in a closing position. In addition, magnetic means are provided, which establish a magnetic attraction force between the connecting modules for assisting the transfer of the connecting modules into the locking position. Due to a movement of the first connecting module or a part of the first connecting module in an opening direction, which differs from the closing direction, the first connecting module can be released from the second connecting module in order to open the closure device in this manner.

In case of a closure device of this kind known from WO 2008/006357 A2 two connecting modules are applied to each other in a vertical closing direction and mechanically latched in doing so. Due to the fact that a magnet is arranged on the first connecting module as well as on the second connecting module, respectively, or a magnet is arranged on one side and a magnetic anchor on the other side the establishing of the mechanical latching and thus the transfer of the closure device into the closing position is magnetically supported. If the magnet is suitably dimensioned, the closure of the closure device occurs almost automatically, when the connecting modules are approaching each other. When moving or rotating the first connecting module relative to the second connecting module, then the mechanical latching can also again be released, wherein simultaneously the magnetic means are sheared off from each other by a lateral movement and thus are removed from each other.

Closure devices of this kind provide on one side in their closing position a safe and resilient connection of two parts to each other and can on the other side be closed in a simple manner and can be again opened in a haptically comfortable manner. The fields of application of such closure devices extend to devices of general kind for (releasable) connecting two parts, as for instance closures of bags, lits or covers, connecting devices for belts or ropes or other components and such.

It is desirable to design the magnetic means, for instance realised by magnets or a magnet and a magnetic anchor, in a small dimension in order to save costs for magnets and also to keep the construction volume of the closure device at a minimum. However, when dimensioning the magnetic means it has also to be considered that these have to effect a sufficient magnetic force in order to establish an attraction force between the connecting modules, which allows for an automatic mechanical latching as far as possible.

In order to be able to close for instance a closure device according to WO 2008/006357 A2 the connecting modules are applied to each other. If the application occurs exactly in the closing direction in case of magnetic means being aligned exactly to each other, a large magnetic attraction force acts between the connecting modules so that the transfer in the closing position is assisted in a desirable manner by the effect of the magnetic means. If the magnetic means are not exactly aligned towards each other, an alignment of the connecting modules towards each other occurs by the magnetic attraction force, that means the magnetic attraction force pulls the connecting modules with alignment of the magnetic means towards each other and into the closing position, in which the magnetic means shall be aligned congruent and frontal to each other as far as possible.

This alignment of the connecting modules to each other when closing the closure device is desirable. A complete optimal alignment occurs practically only, if the magnetic attraction force of the magnetic means comprises a pre-determined strength and the magnetic means are accordingly large dimensioned. If the magnetic means are small dimensioned, it can occur in case of a non-exact alignment of the connecting modules to each other during closing the closure device that the magnetic attraction force is not sufficient in order to align the connecting modules to each other and to transfer said modules automatically into the closing position. The reason is that in case of an inexact positioning of the connecting modules to each other, the respective magnetic means (for instance magnet and anchor) do not exactly face each other, but are rather laterally shifted to each other so that the acting magnetic contraction force is smaller compared to an exact alignment of the magnetic means to each other. If this reduced magnetic attraction force is not sufficient in order to establish the mechanical latching, the connecting modules remain in a in-between position, in which the closure device is not completely closed; an automatic transfer into the closing position does not occur.

In order to achieve an automatic latching also in case of inexact application of the connecting modules to each other for closing the closure device until now an overdimensioning of the magnetic means was required, what made the closure device expensive and required a comparable large construction space.

SUMMARY OF THE INVENTION

The object of the present invention is to provide a closure device for connecting two parts, which allows for a safe, haptically comfortable closing with an automatic magnetically assisted transfer into the closing position as far as possible and can thereby do so with the small dimensioned magnetic means.

Thereby at least one guiding section arranged on the connecting module for guiding the first connecting module into the closing position when arranging the first connecting module on the second connecting module is provided, wherein the at least one guiding section is directed against the opening direction at least with one directional vector component.

In order also to allow on one hand an easy, haptically comfortable closing of the closure device if the connecting modules when applying to, each other are not exactly aligned to each other, an additional guiding section is provided on the second connecting module, which guides the first connecting module into the closing position. The guiding section is aligned such that it is directed with at least one directional vector component against the opening direction pointing for instance cross-wise to the closing direction. In this manner, the guiding section can be directed for instance inclined to the opening direction and can describe thereby an obtuse angle to the opening direction.

A directional vector component has to be understood in this context as a vector component of the directional vector of the guiding section. The directional vector of the guiding section points into the direction, in which the guiding section guides the first guiding module. This directional vector can be dissected mathematically in directional vector components, of which one is directed against the opening direction. A second directional vector component being vertical to the first directional vector component can for instance point into the closing direction.

Due to the guiding section directed in this manner it is achieved that also in case of a mis-alignment of the connecting modules when applying to each other, for instance if the first connecting module is shifted in the opening direction relative to the second connecting module, an easy and automatic closure of the closure device occurs as far as possible. Thereby, the used magnetic means can be dimensioned small, since the alignment of the connecting modules to each other during transfer into the closing position does not occur solely by the magnetic means, but in a guided manner by means of the guiding section. An over-dimension of the magnetic means is thus no more required so that small magnets with a small requirement for construction volume can be used for realising the magnetic means.

In order to establish the formfit mechanical latching, a blocking piece can be arranged on the first connecting module and a spring locking element can be arranged on the second connecting module, which realise together a mechanical locking device. The blocking piece as well as the spring locking element can comprise latching projections according to the type of latching elements, which engage with each other in a form fit manner for establishing the mechanical latching. When applying the first connecting module on the second connecting module, the blocking piece of the first connecting module pushes the spring locking element of the second connecting module to the side until the blocking piece snaps into engagement with the spring locking element and establishes the mechanical latching between the connecting modules.

In case of such a mechanical latching the guiding section is advantageously arranged in closing direction in front of the latching projection of the spring locking element. The first connecting module is thereby aligned by means of the guiding section, if said module is applied with a mis-alignment on the second connecting module (thus not exactly aligned along the closing direction), at first to the second connecting module before subsequently the latching is established. At first an alignment occurs thus by the at least one guiding section such that the magnetic means facing each other in an optimum manner for establishing a maximum attraction force; only then the latching projections of the locking piece and the spring locking element engage. This guarantees that the establishing of the mechanical latching is assisted as far as possible by the magnetic means and an over-dimension of the magnetic means is not necessary.

The guiding section allows therefore that the magnetic means are optimal—without lateral mis-alignment—aligned to each other for establishing the mechanical latching and that said magnetic means magnetically attract each other for the best possible support of the latching process. Simultaneously, the guiding section does not prevent a lateral movement of the first connecting module in the opening direction for opening the closure device since the guiding section is arranged in closing direction in front of the latching projection of the spring locking element on the second connecting module.

The spring locking element and the blocking piece are moved towards each other for releasing the first connecting module from the second connecting module so that the spring locking element is moved along the opening direction out of the area of the at least one blocking piece. The opening direction can be aligned cross-wise to the closing direction, wherein the mechanical latching between the blocking piece and the spring locking element is overridden since the latching projections of the blocking piece and the spring locking element are moved lateral that means tangential out of engagement.

The at least one guiding section for guiding the first connecting module into the closing position can be arranged for instance on a spring locking element or a connector holder of the second connecting module. In the first case, the spring locking element serves on one side the establishment of the mechanical latching and on the other side also the guiding of the first connecting module into the closing position. In the second case these functions are separated: The spring locking element serves the mechanical latching while the guiding section on the connector holder of the second connecting module guides the first connecting module in direction of the closing position.

In a first embodiment, the blocking piece of the first connecting module can be designed essentially rotational symmetrically and can comprise a latching projection for mechanical latching with a latching projection of a spring locking element of the second connecting module. The spring locking element can thereby be designed circular and can extend about a centre axis continuing parallel to the closing direction and can be arranged on a connector holder of the second connecting module. The spring locking element is thereby sectionally opened in circumferential direction and realises in this manner a recess, which allows for removal of the blocking piece of the first connecting module in the opening direction (cross-wise to the closing direction) out of the spring locking element of the second connecting module and thus a release of the closure device.

The spring locking element formed essentially circular can be arranged in a variant torque-proofed on the connector holder of the second connecting module. The recess of the spring locking element is hereby—if looked at from the centre axis—positioned such that the spring locking element is opened in opening direction so that the blocking piece of the first connecting module can be moved in the opening direction out of the spring locking element of the second connecting module. The spring locking element keeps in this manner the blocking piece against the closing direction by a formfit mechanical latching in the connector holder of the second connecting module, but not against the opening direction, in which the spring locking element is open. The connecting modules are hold at each other against the opening direction in particular via the magnetic attraction force of the magnetic means, which has to be overcome for opening.

In a second variant, the spring locking element can also be arranged torque-proofed on the connector holder of the second connecting module. The spring locking element is thereby rotatable about the centre axis for releasing the first connecting module from the second connecting module, wherein in a locked position the spring locking element is rotated such that it is not open in the opening direction (looked at from the centre axis of the spring locking element) (this means the recess of the spring locking element is, if looked at from the centre axis, in another direction as the opening direction) so that the blocking piece cannot be taken out of the spring locking element in the opening direction. The mechanical latching of spring locking element and blocking piece is thus locked. In contrast in an unlocked position the spring locking element is rotated about the centre axis for releasing the first connecting module from the second connecting module such that the recess of the spring locking element, if looked at from the centre axis, is arranged in the opening direction and the spring locking element is thus open in the opening direction so that the first connecting module can be moved with its blocking piece in the opening direction out of the spring locking element of the second connecting module.

A lever can be arranged on the spring locking element in this case for a simple actuation of the spring locking element, wherein the spring locking element can be rotated out of the locked into the unlocked position and vice versa by means of said lever. In this context it is also conceivable to preload the spring locking element by using for instance a mechanical spring in a position so that the spring locking element is for instance always arranged in the locked position without actuating the lever, in which a release of the first connecting module from the second connecting module is not possible.

It is also conceivable to arrange the guiding section of the second connecting module and a section of the first connecting module interacting with the guiding section spatially separated from the magnetic means and the mechanical latching and the mechanical latching and to realise for instance by a crank guidance or such.

In a second embodiment a blocking piece of the connecting module can extend essentially in a longitudinal direction with an angle to the closing direction and can comprise a latching projection for mechanically latching with a latching projection of a spring locking element of the second connecting module. In this case, locking piece and spring locking element are not designed rotational symmetrically but extend in a longitudinal direction on the first connecting module or a second connecting module. Latching projections are designed on the blocking piece as well as on the spring locking element, wherein said projections engage with each other when applying the first connecting module to the second connecting module and establish the mechanical latching. The first connecting module and the second connecting module are moved relatively to each other along the opening direction relatively to each other for releasing the closure device, wherein the opening direction is directed along the longitudinal direction of the blocking piece.

The blocking piece can be thereby directed such that the opening direction is directed with a directional vector component against a main loading direction so that no opening of the closure device can occur under the action of a loading in the main loading direction.

As already mentioned above, the magnetic attraction force of the magnetic means has to be overcome for opening the closure device. In order to additionally secure the closure device against an unintentional release in the opening direction, additional latching means can be provided, which latch the first connecting module also against the opening direction for instance in a formfitted manner with the second connecting module. For this reason, the opening of the closure device is hampered.

These latching means can also be realised by the spring locking element, which completely encompasses the blocking piece in the closing position such that a spring force of the spring locking element has to be overcome for releasing the connecting modules from each other. Due to the complete encompasses the spring locking element counteracts an opening of the closure device, wherein a suitable force required for opening can be adjusted by dimensioning the spring locking element and the magnetic means.

The magnetic means can be formed by a (permanent) magnet arranged in each case on the first connecting module and on the second connecting module or on the one side by a magnet and on the other side by a magnetic anchor, for instance made of ferromagnetic steel. The magnetic means on the first connecting module and the second connecting module are aligned to each other in a suitable manner for establishing the magnetic attraction force between the connecting modules. If the magnetic means are realised by two magnets, they are directed towards each other with opposite poles.

The effect of the guiding section becomes in particular noticeable in case of a magnetic system of a magnet and an anchor. The advantage of these magnetic systems is that only one magnet is required, what reduces the costs. These magnetic systems have however only a much reduced lateral self-aligning torque due to physical reasons. However, by providing at least on guiding section the magnet can also be smaller dimensioned when realising the magnetic means by a magnet and an anchor in order to safe costs and construction volume.

Due to the movement of the first connecting module relative to the second connecting module for opening the closure device, the magnetic attraction force is simultaneously also reduced between the first connecting module and the second connecting module by removing the magnetic means from each other by moving the connecting modules along the opening direction. In the opened state the mechanical latching is without engagement and the magnetic means are removed from each other so that the first connecting module can be taken out from the second connecting module in a simple easy manner and the closure device can be opened.

In a further embodiment of a closure device the closure device can also be formed by a first closing member and a second closing member, which can be applied to each other in the opening direction and which comprise two or more connecting modules, respectively.

In a first variant, the one closing member can comprise for instance two first connecting modules and the other closing member can comprise two second connecting modules, or in a second variant, both closing members can comprise in each case a first connecting module and a second connecting module. Thus, two connecting modules are arranged in these variants on each closing member, namely either on the one hand two first connecting modules and on the other hand two second connecting modules or in each case a first and a second connecting module.

The closing members lock in turn in closing direction and are mechanically latched to each other in the closing position via the respective two connecting modules arranged on the closing members. The mechanical latching occurs thus so to say twice as in the closing position two connecting module pairs are mechanically latched to each other and the first closing member and the second closing member are locked with each other via two form fitted mechanical latchings.

In this context, it is also conceivable to provide more than two connecting modules per closing member, for instance three or more, which are arranged in series or on a circle.

It is conceivable to design the closing members with the connecting modules arranged thereon such that they can be opened by a linear movement towards each other. However, it is also conceivable and of an advantage if the two closing members are pivotable towards each other about a pivot axis for opening in order to move in this manner the connecting modules of the closing members relatively to each other for opening. Since the closing members are pivoted towards each other, the connecting modules of the closing members are moved relatively to each other so that the blocking pieces of the first connecting modules are becoming disengaged with the spring locking elements of the second connecting modules. The pivot axis can be thereby directed parallel to the closing direction and can be arranged between the connecting modules concentrically on the first and second closing member.

If in each case a first and a second connecting module is arranged on the first closing member and on the second closing member, the first closing member and the second closing member can be identical in construction, in order to be applied mirror-inverted to each other. The first closing member and the second closing member comprise thus in each case a blocking piece and a spring locking element, which are brought into engagement with the spring locking element or the blocking piece of the other closing member for transferring the closure device into the closing position. The identical construction of the closing members saves construction costs since no different tools are required for the production of the closing members.

BRIEF DESCRIPTION OF THE DRAWINGS

The idea of the invention shall be explained in the following in more detail by means of the embodiments illustrated in the figures. It shows.

DETAILED DESCRIPTION OF THE PREFERRED EMBODIMENTS

Figure 1:
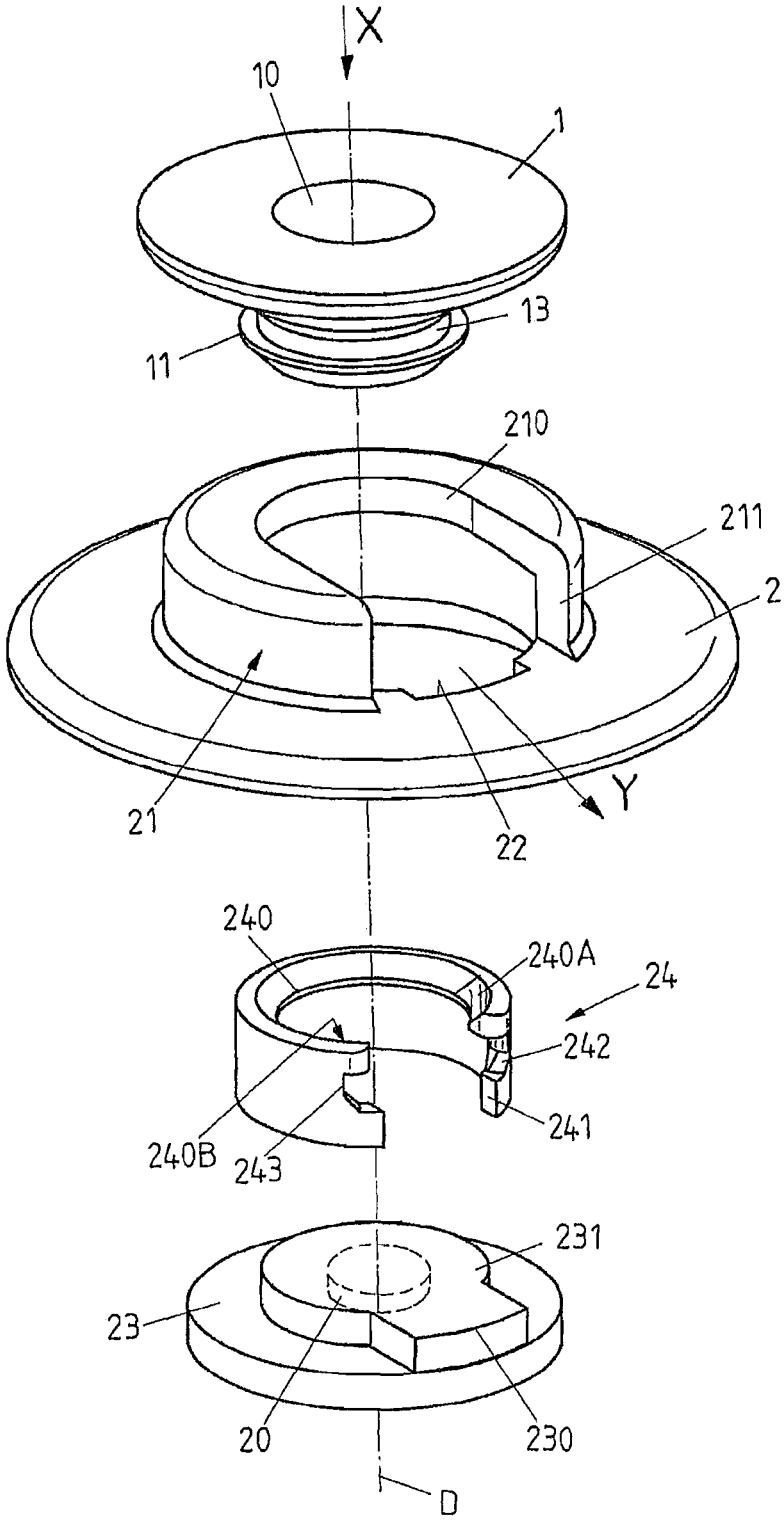
FIG. 1 an explosive view of a first embodiment of a closure device for connecting two parts.

FIGS. 1 to 7 show a first embodiment of the closure device with a first connecting module 1 and a second connecting module 2 which serve for connecting two parts, for instance as a closure for a back, for connecting ropes or belts or connecting other components.

The parts to be connected are thereby connected with the first connecting module 1 and the second connecting module 2 and are releasable coupled to each other via the connecting modules 1, 2.

The closure device provides a mechanical latching via the connecting modules 1, 2 by engaging in a closed position, a latching projection 11 of the first connecting module 1 arranged on a blocking piece 13 form fit with a latching projection 240 of a spring locking element 24 of the second connecting module 2.

The blocking piece 13 with the latching projection 11 arranged thereon extends according to the type of a pin rotational symmetric on the first connecting module 1.

The spring locking element 24 is arranged torque-proofed via a base plate 23 but with a radial clearance on a connector holder 21 of the second connecting module 2 and encompasses a retaining member 231 projecting from the top side of the retaining plate 23, wherein a radial projecting formation 230 reaches through a lateral recess 241 opening the spring locking element on its circumference of the otherwise circular spring locking element 24 and fixes therethrough the spring element 24 torque-proof on the second connecting module 2.

The base plate 23 is pressed together with the spring locking element 24 arranged thereon in a underside recessed 22 of the second connecting module 2 for arranging the spring locking element 24 on the connector holder 21, as apparent from FIG. 1.

Figure 2A:
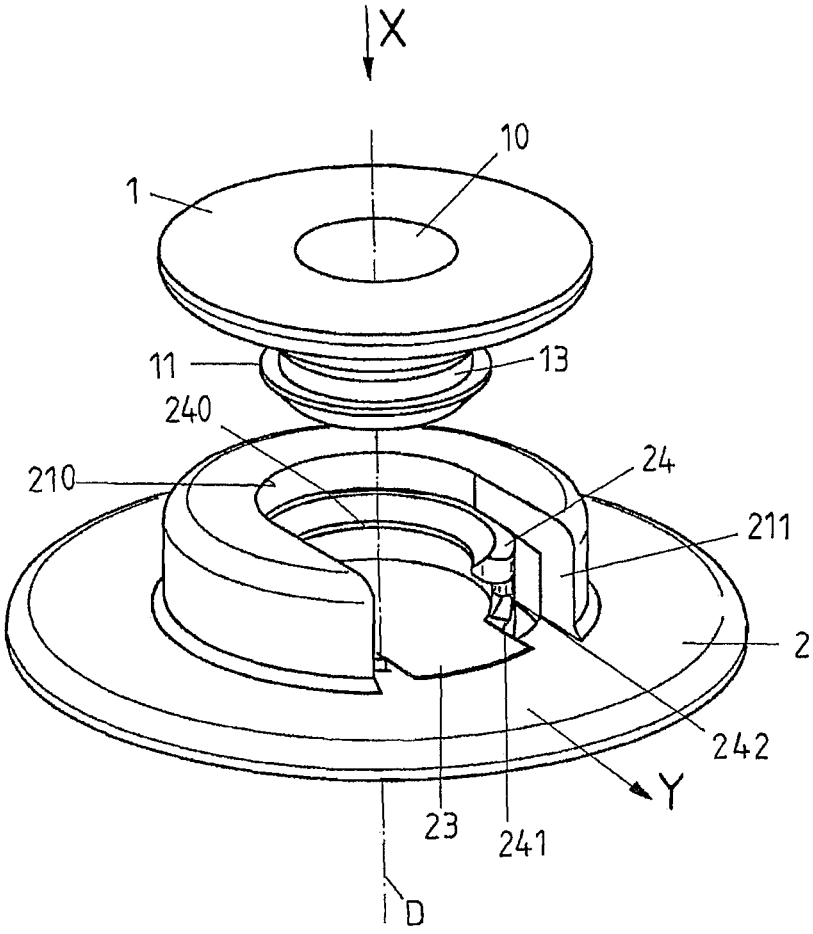
FIG. 2A a perspective view of a closure device during closure.

As in FIG. 2A illustrated, the first connecting module 1 is applied in a closing direction X to the second connecting module 2 for establishing the closed position by inserting the blocking piece 13 in an upper side connector opening 210 of the connector holder 21. Thus, the latching projection 11 of the blocking piece 13 of this first connecting module 1 comes in contact with the latching projection 240 of the spring locking element 24 of the second connecting module 2 and pushes said element radial outwards until the latching projection 11 engages latchingly with the latching projection 240.

Magnetic means 10, 20 are in each case arranged on the first connecting module 1 and on the second connecting module 2, wherein said magnetic means effect a magnetic attraction force between the connecting module 1, 2 towards each other. The magnetic means 10, 20 can be realised in each case by a magnet or on the one hand by magnet and on the other hand by a magnetic anchor, for instance of a ferromagnetic steel. The magnetic means 10, 20 serve to assist magnetically the transfer of the connecting modules 1, 2 into the closed position so that the mechanical latching of the connecting modules 1, 2 occurs automatically as far as possible, when the connecting modules 1, 2 are applied to each other.

Figure 7A:
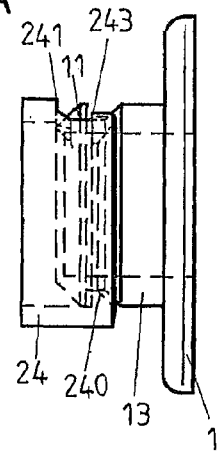
FIG. 7A a side view of the closure device in closing position.
Figure 7B:
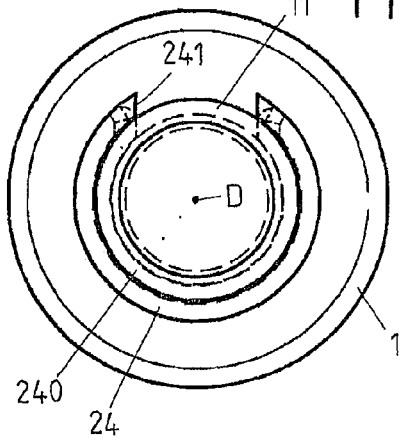
FIG. 7B a view of the closure device from below in the closing position.

In the closed position illustrated for instance in FIGS. 7A and 7B the first connecting module 1 and the second connecting module 2 are form fitted latched to each other, wherein the latching projections 11, 240 keep the connecting modules 1, 2 against the closing direction X mechanically to each other in engagement.

The first connecting module 1 is kept cross-wise to the closing direction X via the lateral limitation of the connector holder 21 on the second connecting module 2. The connector holder 21 is however like the circular spring locking element 24 lateral opened in circumferential direction and comprises a lateral recess 211, through which the first connecting module 1 can be moved with its blocking piece 13 in an opening direction Y cross-wise to the closing direction X out of the latching engagement with the second connecting module 2.

Figure 2B:
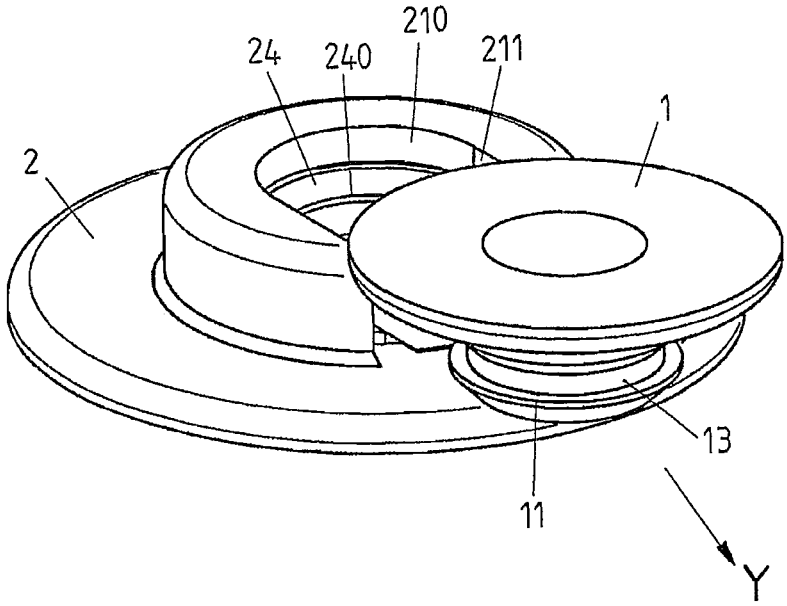
FIG. 2B a perspective view of a closure device during opening.
Figure 3:
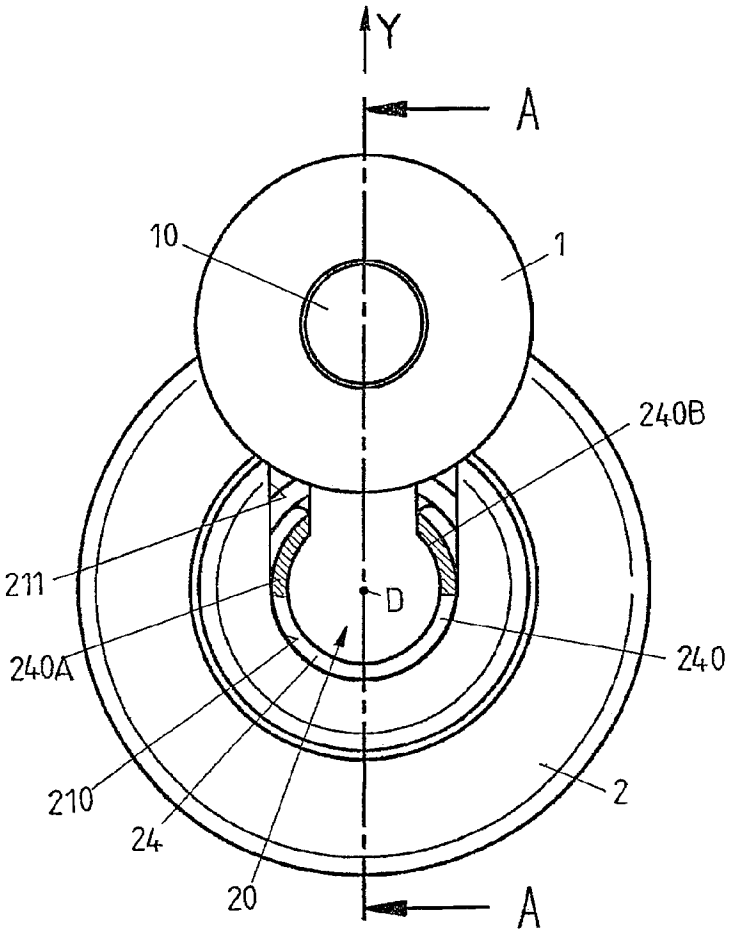
FIG. 3 a top view of the closure device during opening.
Figure 4:
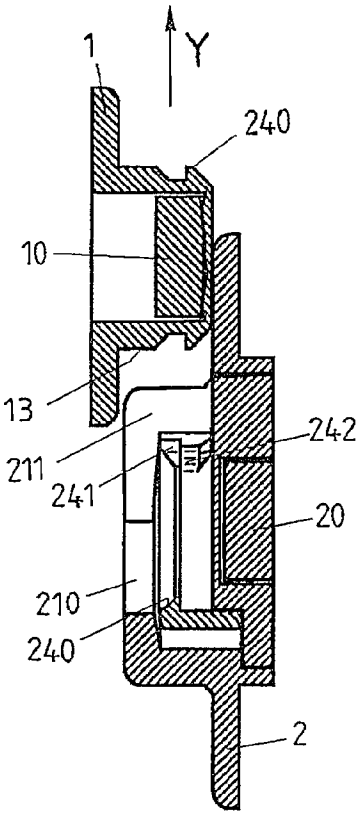
FIG. 4 a sectional view through the closure device along the line A-A according to FIG. 3.
Figure 5:
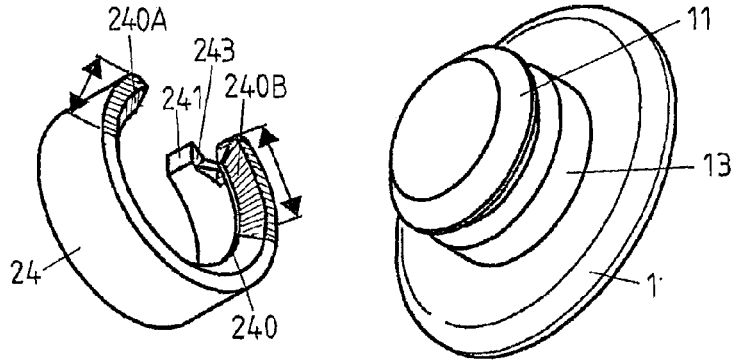
FIG. 5 a perspective view of a first connecting module and a spring locking element of a second connecting module of the closure device.

The first connecting module 1 is moved in the opening direction Y relative to the second connecting module 2 for opening the closure device such that the blocking piece 13 with the latching projection 11 arranged thereon is moved tangential (lateral) out of the area of the spring locking element 24 with the latching projection 240 arranged thereon and is removed through the recess 211 out of the connector holder 21 (see FIG. 2B).

The closure device can on one hand be closed in a simple and haptically comfortable manner by applying the first connecting module 1 to the second connecting module 2 in the closing direction X in order to connect the connecting modules 1, 2 mechanically tight and secure to each other in the closed position. By moving the first connecting module 1 into the opening direction Y the closure device can then in an also easy and haptically comfortable manner be opened again, wherein on the one hand due to the opening movement the mechanical latching is released and on the other hand also the magnetic means 10, 20 are removed from each other by tangential movement so that the magnetic attraction force is weakened.

The first connecting module 1 is kept by the magnetic attraction force of the magnetic means 10, 20 on the second connecting module to avoid an unintentional opening in the opening direction Y. The spring locking element 24 encompasses additionally the blocking piece 13 on its circumference so that in order to open the closure device in addition to the magnetic force of the magnetic means 10, 20 a spring force of the spring locking element 24 for radial bending up of the spring locking element 24 has also to be overcome. The force required for opening can be adjusted in a desirable manner by a suitable dimensioning of the magnetic means 10, 20 and the spring locking element 24, wherein on one hand a haptically comfortable opening should be possible, but simultaneously an undesired release should be avoided if possible or should be at least hampered.

As in particular can be seen in FIG. 1, the spring locking element 24 comprises in the area of the recess 241 below the latching projection 240 recesses 242, 243, which are adapted to the latching projection 11 of the blocking piece 13 and allow a movement of the blocking piece 13 out of the spring locking element 24 by overcoming the retentive spring force of the spring locking element 24.

Figure 6A:
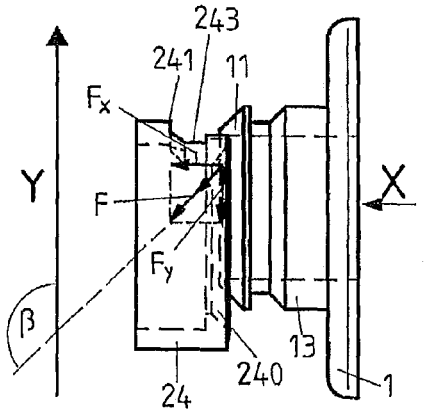
FIG. 6A a side view of the closure device during closure.
Figure 6B:
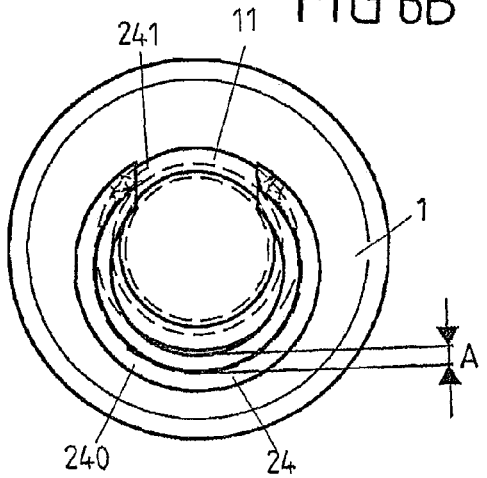
FIG. 6B a view of the closure device from below during closure.

The closure device is being closed by applying the first connecting module 1 on the second connecting module 2, wherein in an ideal manner the connecting module 1 and the connecting module 2 are moved towards each other exactly along the closing direction X and are applied to each other. However, this closure movement will realistically not occur exactly in closing direction X, and the connecting modules 1, 2 will not be exactly aligned to each other. In particular, as illustrated in FIG. 6B, a mis-alignment A can occur along the opening direction Y between the connecting modules 1, 2 so that when applying the connecting modules 1, 2 to each other, said modules are not centred to each other and therefore not aligned in an optimal manner to each other.

In order to allow an as far as possible automatic transfer of the connecting modules 1, 2 into to the closed position when using small magnets for realising the magnetic means 10, 20, guiding sections 240A, 240B are arranged on the spring locking element 24 by elongating the latching projection 240, wherein said guiding sections are adjacent to the recess 241. As illustrated in FIG. 6A, these guiding sections 240A, 240B, continue inclined to the opening direction Y and describe in particular an obtuse angle β to the opening direction Y. The guiding sections 240A, 240B are thereby aligned such that a spatial directional vector F corresponding to the gradient of the guiding sections 240A, 240B is directed against the opening direction Y at least with one directional component FY.

As illustrated in FIG. 6A, the directional vector F can be divided in a mathematical sense in directional vector components FX, FY (and additionally optionally also in a third directional vector component FZ in a three dimensional space), of which the directional vector component FX is directed in the closing direction X and the directional vector component FY is directed against the opening direction Y.

By providing the guiding sections 240A, 240B the first connecting module 1 is guided into the closed position when applying to the second connecting module 2, wherein these guiding sections 240A, 240B have in particular an effect when the first connecting module 1 is shifted in the opening direction Y by a misalignment A relative to the second connecting module 2. The guiding sections 240A, 240B escort the first connecting module 1 then against the opening direction Y into the closed position, balance therefore the misalignment A and centre the connecting modules 1, 2 to each other.

In the closed position as illustrated in FIGS. 7A, 7B, the connecting modules 1, 2 are concentrically aligned to a centre axis D, are centred to each other and are engaged with each other in a latching manner.

By providing the guiding sections 240A, 240B the magnetic means can be small dimensioned since the transfer into the closed position and the centring of the connecting modules 1, 2 to each other is assisted in a guided manner via the guiding section 240A, 240B, and therefore does not have to be effected solely by a magnetic attraction of the magnetic means 10, 20. Due to the use of small magnets, the costs of the closure device are reduced. Furthermore, the required construction volume is downsized.

Figure 8:
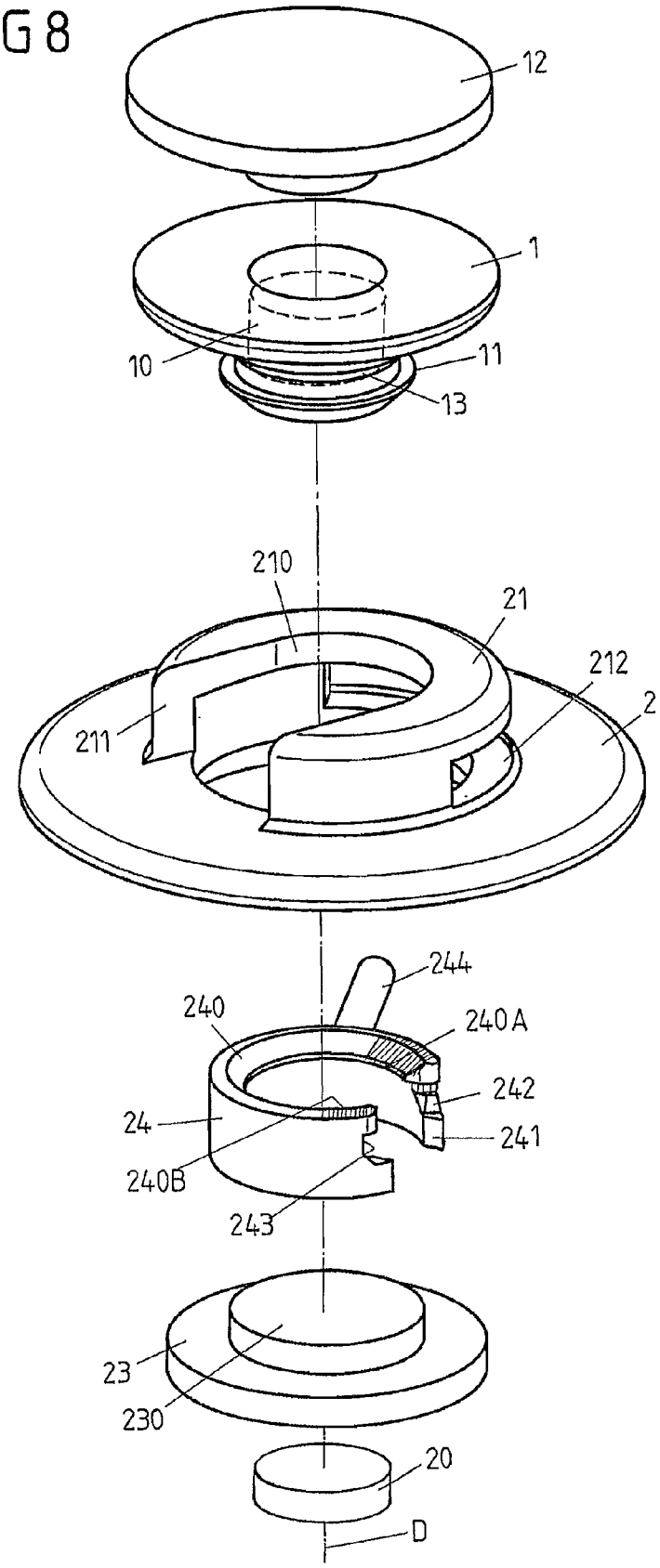
FIG. 8 an explosive view of a second embodiment of a closure device.

FIGS. 8 to 10 show a second embodiment of a closure device. Here components of same function are provided with the same reference sign as previously, if useful.

The closure device according to FIGS. 8 to 10 is in its functionality as far as possible identical to the previously closure device described by means of FIGS. 1 to 7. In contrast to the previously described closure device solely the spring locking element 24 is arranged in case of the closure device according to FIGS. 8 to 10 rotatably about its centre axis D on the second connecting module 2 and comprises a lever 244, which reaches through an opening 212 on the connector holder 21 of the second connecting module 2 and can be actuated for rotating the spring locking element 24.

The spring locking element 24 encompasses a rotational symmetrical retaining element 230 of the base plate 23 without being fixed to it.

Figure 9A:
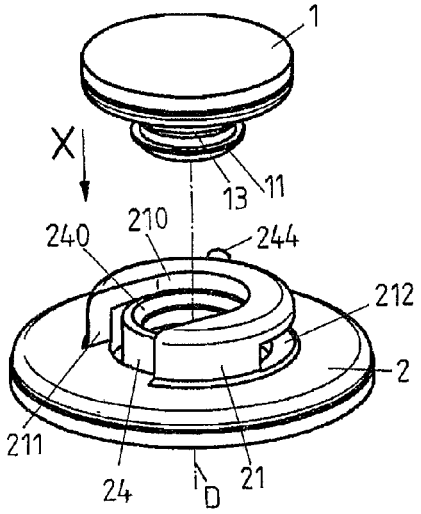
FIG. 9A a perspective view of a closure device during closure.
Figure 9B:
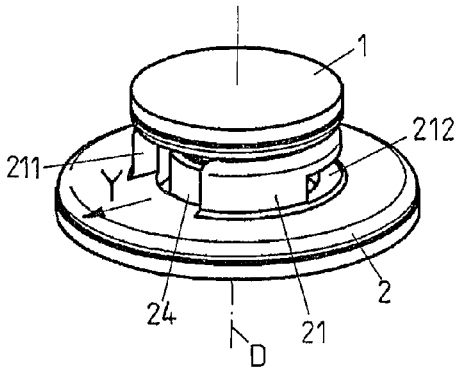
FIG. 9B a perspective view of the closure device in the closing position.

As in case of the previously described closure device also in case of the closure device according to FIGS. 8 to 10, the first connecting module 1 is mechanically latched to the second connecting module 2 by applying in the closing direction X to the second connecting module 2 and thus is brought in a closed position (see FIGS. 9A and 9B). In this closed position, the spring locking element 24 is distorted to the connector holder 21 of the second connecting module 2 such that the recess 241 is in a different angular position than the recess 211 of the connector holder 21 and the recesses 241, 211 are therefore not congruent to each other. In the closed position according to FIG. 9B, the first connecting module 1 is thus mechanically latched to the second connecting module and furthermore secured to the second connecting module 2 by not being able to move the first connecting module 1 in the opening direction Y out of the connector holder 21 of the second connecting module 2.

Figure 9C:
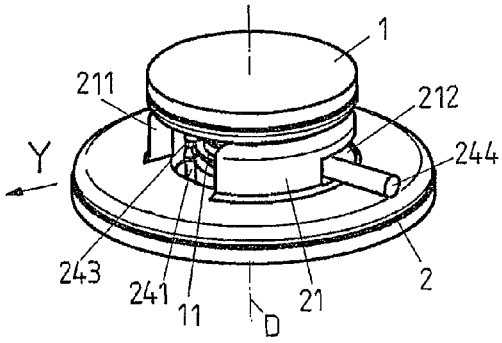
FIG. 9C a perspective view of the closure device before opening.
Figure 9D:
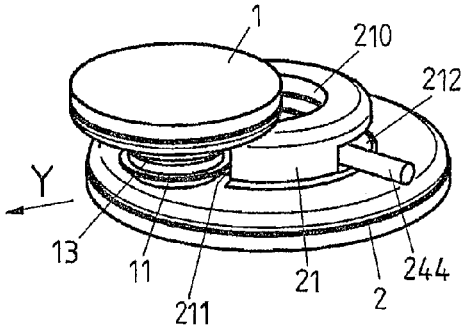
FIG. 9D a perspective view of the closure device during opening.

The lever 244 is pivoted in the reach through opening 212 for opening the closure device and thus the spring locking element 24 is distorted about the centre axis D so that the recesses 241, 211 of the spring locking element 24 and the connector holder 21 come into a congruent position (see FIG. 9C). The first connecting module 1 is thus not any longer kept in the connector holder 21 against the opening direction Y via the spring locking element 24 and can be moved in the opening direction Y out of the connector holder 21 in order to open the closure device in this manner (see FIG. 9D).

Figure 10A:
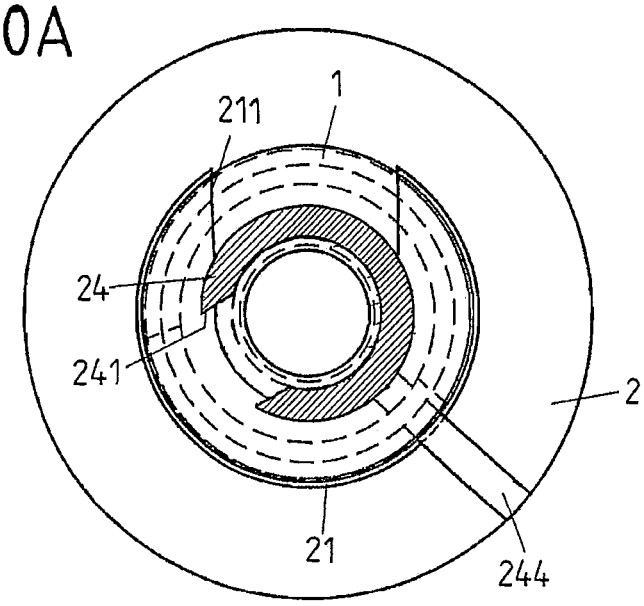
FIG. 10A a view of the closure device from below in the closed position.
Figure 10B:
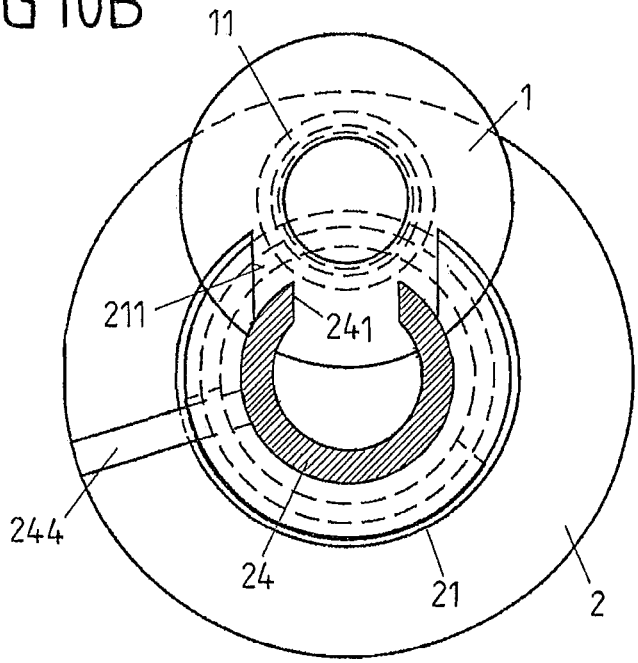
FIG. 10B a view of the closure device from below during opening.

The views from below according to FIGS. 10A and 10B illustrate the angular position of the spring locking element 24 to the connector holder 21 in the locked position (FIG. 10A) and the unlocked position (FIG. 10B).

Figure 11:
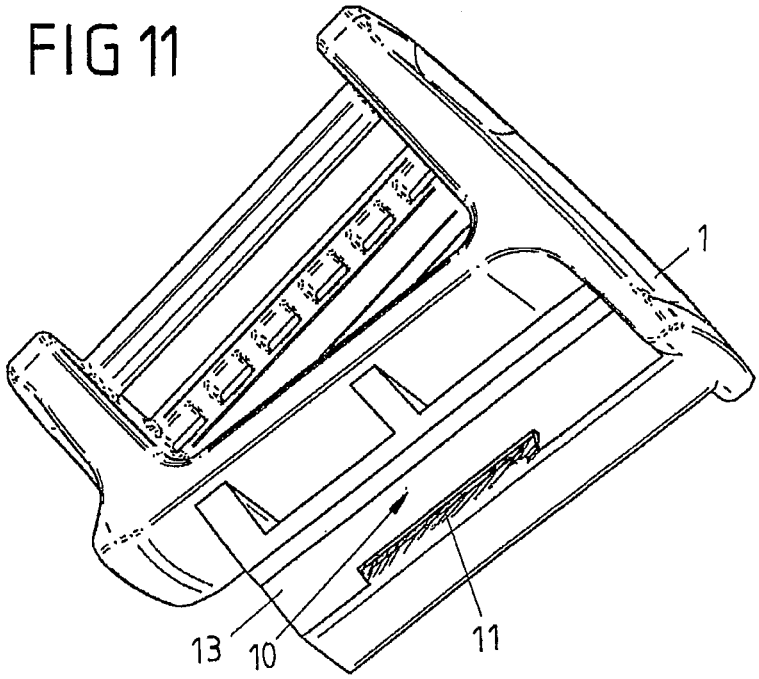
FIG. 11 a perspective view of a third embodiment of a closure device.
Figure 11:
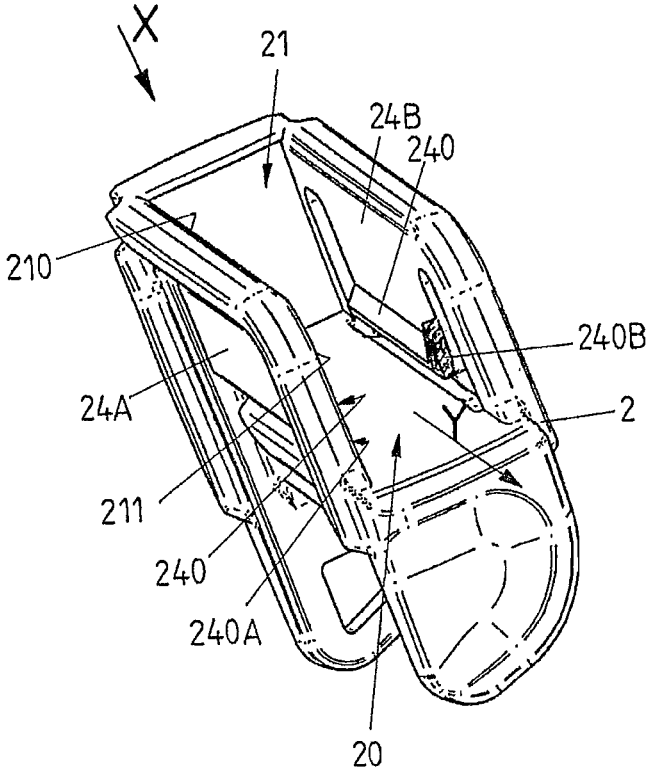
Figure 12A:
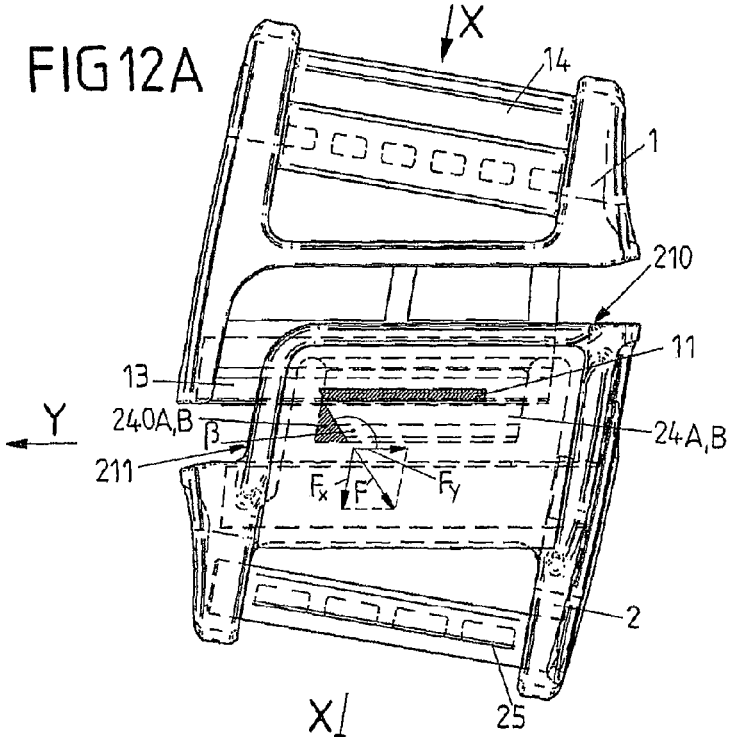
FIGS. 12A, 12B views of the closure device during closing.
Figure 12B:
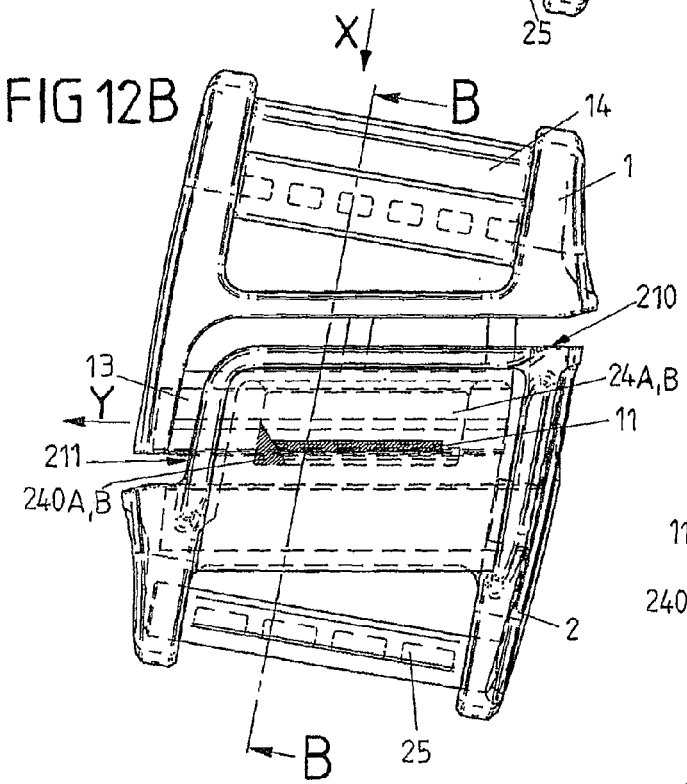
Figure 13:
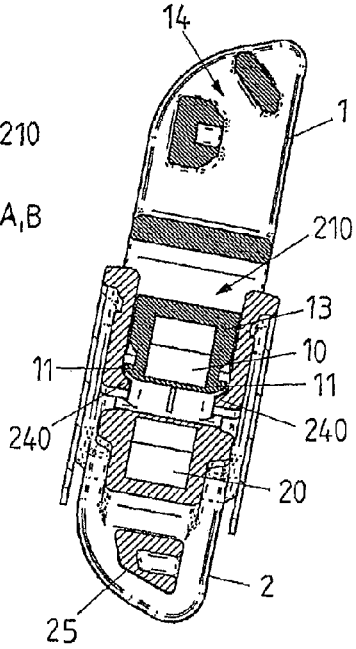
FIG. 13 a sectional view through the closure device during closing along the line B-B according FIG. 12B.

A third embodiment of a closure device in form of a snap buckle is illustrated in FIGS. 11 to 13. Again, as far as suitable components of the same function are provided as previously with the same reference signs.

In case of the snap buckle according to FIGS. 11 to 13 a blocking piece 13 of a first connecting module 1, in contrast to the previously described embodiments, is not formed rotational symmetrically but elongated with lateral latching projections 11 and engages in a closed position with an elongated connector holder 21 of the second connecting module 2 with an upper connector opening 210 and a lateral recess 211. In the closed position, the latching projections 11 are engaged form fitted with two spring locking elements 24A, 24B and latching projection 240 arranged thereon.

As also in case of the previously described embodiments, the transfer into the closing position occurs by applying the first connecting module 1 in a closing direction X to the second connecting module 2. The transfer in the closed position is thereby magnetically assisted by magnetic means 10, 20, for instance in each case a magnet or on the one hand a magnet and on the other hand a magnetic anchor.

The closure device in form of the snap buckle can be opened by lateral movement in an opening direction Y in order to lateral dis-engage the latching projections 11 by this tangential movement with the latching projections 240 of the spring locking element 24A, 24B. In so far there are no functional differences to the previously described embodiments.

As apparent from FIGS. 11 and 12A, 12B, a guiding section 240A, 240B is designed in each case on the spring locking elements 24A, 24B, wherein said guiding section gets into abutment on the face side with the latching projections 11 in the manner illustrated in FIGS. 12A, 12B when applying the first connecting module 1 to the second connecting module 2, in order to guide the first connecting module 1 into the closed position.

The guiding sections 240A, 240B comprise in each case a directional vector F pointing along the inclination of the guiding section 240A, 240B, wherein said vector describes an obtuse angle β to the opening direction Y and is directed with a directional vector component FY against the opening direction Y.

In the closed position, the first connecting module 1 and the second connecting module 2 are then aligned to each other in an optimal manner, wherein in particular the magnetic means 10, 20, for instance a magnet and a magnetic anchor, facing each other in an optimum manner and effect a maximal magnetic attraction force.

As apparent from FIG. 11, the guiding sections 240A, 240B are arranged in closing direction X above the latching projections 240 and are not in abutment with the blocking piece 13 or its latching projections 11 in the closed position, in which the latching projections 11 of the blocking piece 13 engage behind the latching projections 240 of the spring locking element 24A, 24B. The guiding sections 240A, 240B do thus not counteract an opening of the closure device and have influence only when transferring the closure device into the closed position.

As for instance apparent from FIG. 13, belt connections 14, 24 in form of a snap buckle are formed on both sides of the closure device, wherein said belt connections serve the connection of the belt to the connecting modules 1, 2 of the snap buckle. The snap buckle can serve in particular the transfer of tensile loadings and absorbs for this the acting loading forces via the mechanical latching of the latching projections 11, 240 in a form fitted manner.

Figure 14:
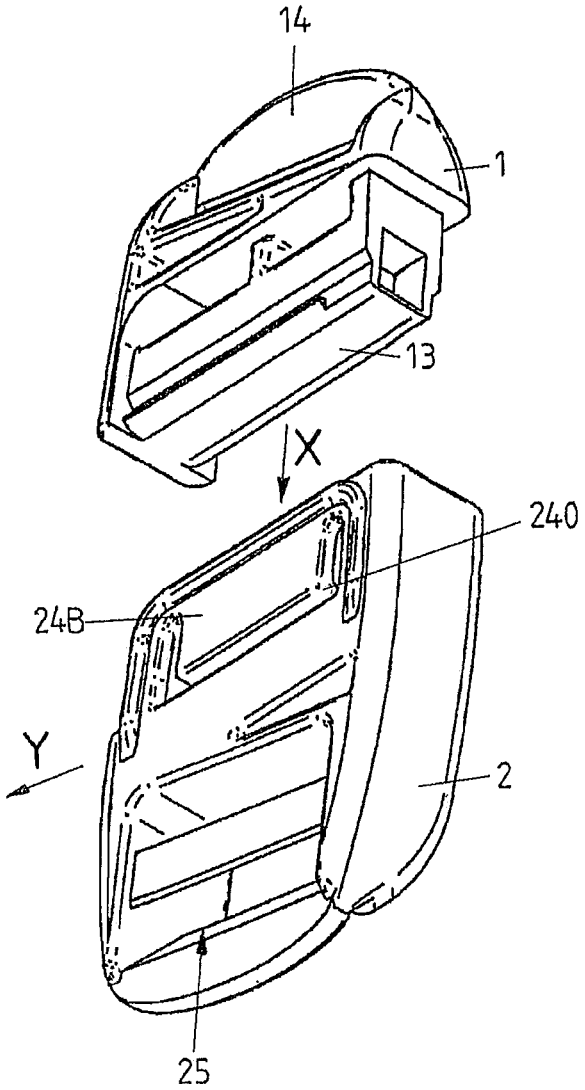
FIG. 14 a perspective view of a closure device according the prior art.
Figure 15B:
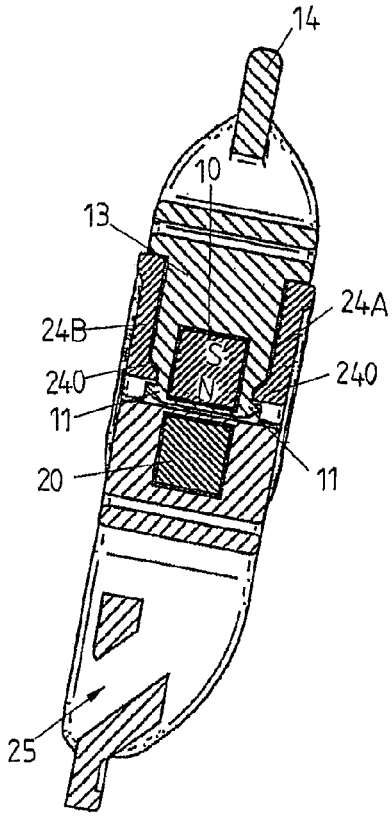
FIG. 15B a sectional view of the closure device along the line C-C according to FIG. 15A.
Figure 15A:
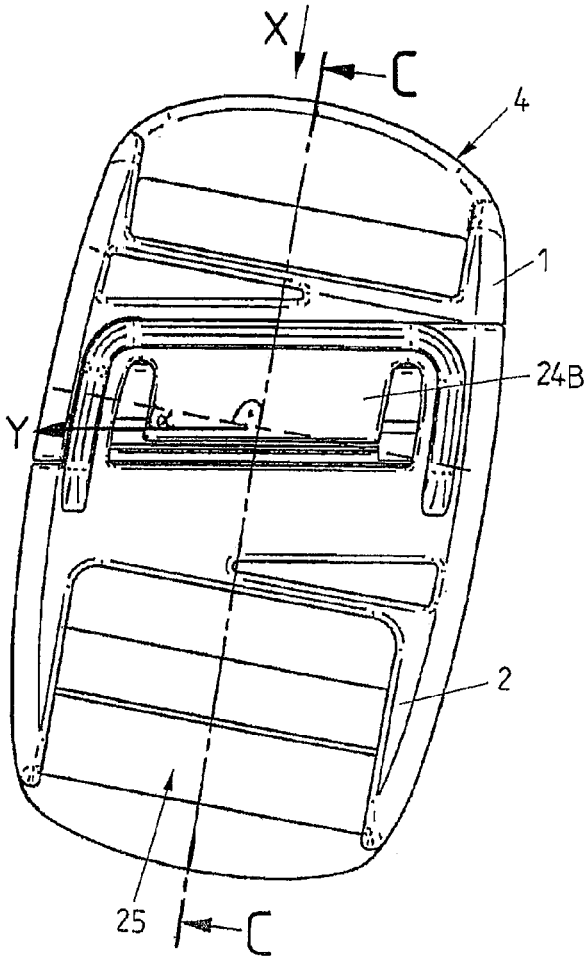
FIG. 15A a front view of the closure device in closed position.
Figure 16A:
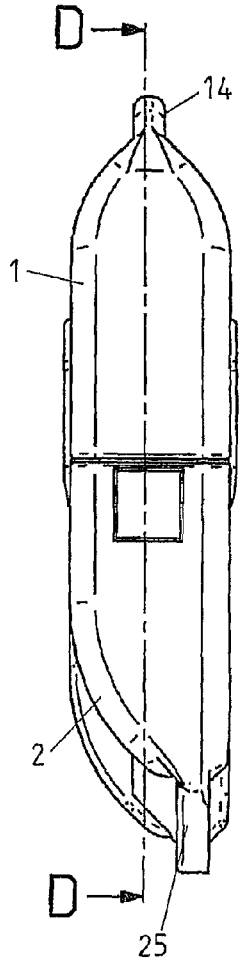
FIG. 16A a side view of the closure device.
Figure 16B:
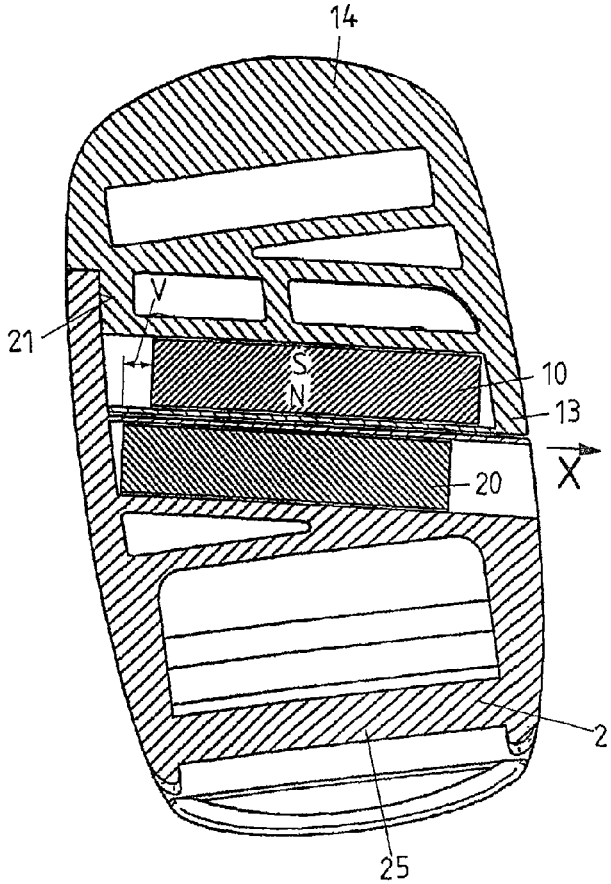
FIG. 16B a sectional view of the closure device along the line D-D according to FIG. 16A.

A closure device with connecting modules 1, 2, which corresponds essentially to the closure device according to FIGS. 11, 13, is illustrated in FIGS. 14 to 16. Only the guiding sections 240A, 240B are not present in case of the closure device according to FIGS. 14 to 16.

In order to guarantee also in case of the closure device according to FIGS. 14 to 16 that the connecting modules 1, 2 are exactly arranged to each other and aligned in the closed position (FIGS. 16 and 17) the magnetic means 10, 20, for instance a magnet 10 and a magnetic anchor 20, are arranged to each other by a misalignment V in case of the closure device according to FIGS. 14 to 16 so that also in the closed position a force against the opening direction Y is established which serves as a kind of pretension and shall guarantee a transfer into the closed position. For this a large dimensioning of the magnetic means 10, 20 is required, which is redundant due to the provided guiding sections in the previously described embodiments according to FIGS. 1 to 13.

As illustrated in FIG. 15A, it is provided in case of the closure device in form of the snap buckle to arrange the opening direction Y with an angle $\alpha$ to a horizontal. The opening direction Y is thus not directed cross-wise to the closing direction X, but with an angle $\alpha$ to the cross direction. Through this it is achieved that in case of a loading force acting against the closing direction X, the closure device cannot open in a undesired manner since the first connecting module 1 is pushed by the loading force against the opening direction Y into the connector holder 21 and counteracts thus an opening.

Figure 17:
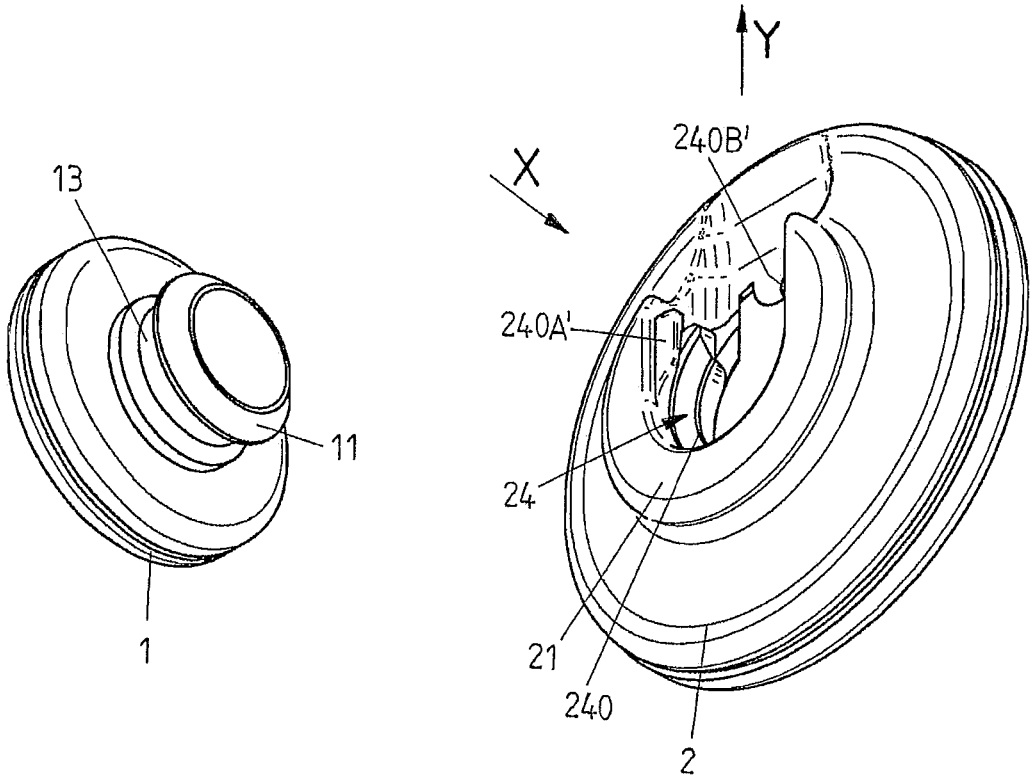
FIG. 17 a perspective view of a closure device with a guiding section arranged on the connector holder of the second connecting module.

FIG. 17 shows a closure device which corresponds in its construction and its function essentially to the closure device according to FIGS. 1 to 7. In contrast to the closure device according to FIGS. 1 to 7 (additional) guiding sections 240A', 240B' are however provided on the connector holder 21, wherein said guiding sections guide the first connecting module 1 with the blocking piece 13 arranged thereon for establishing the closed position and are thereby arranged if looked at in closing direction X in front of the spring locking element 24 and the latching projection 240 formed thereon. When applying the first connecting module 1 to the second connecting module 2, the latching projection 11 of the blocking piece 13 slides along the guiding sections 240A', 240B' and is guided, when shifting the first connecting module in the opening direction Y relative to the second connecting module 2, against the opening direction Y, in order to align the magnetic means of the connecting modules 1, 2 to each other. The establishment of the mechanical latching occurs thus with connecting modules 1, 2 aligned to each other in an optimal assisted manner.

FIGS. 18 to 21 show a further embodiment of a closure device, which uses two closing members 3, 4, on which in each case a first connecting module 1 and a second connecting module 2 are arranged. The closing members 3, 4 are designed with an identical construction and comprise in each case a blocking piece 13 with a latching projection 11 of the first connecting module 1 and a connector holder 21 with a spring locking element 24 of the second connecting module 2.

Figure 19C:
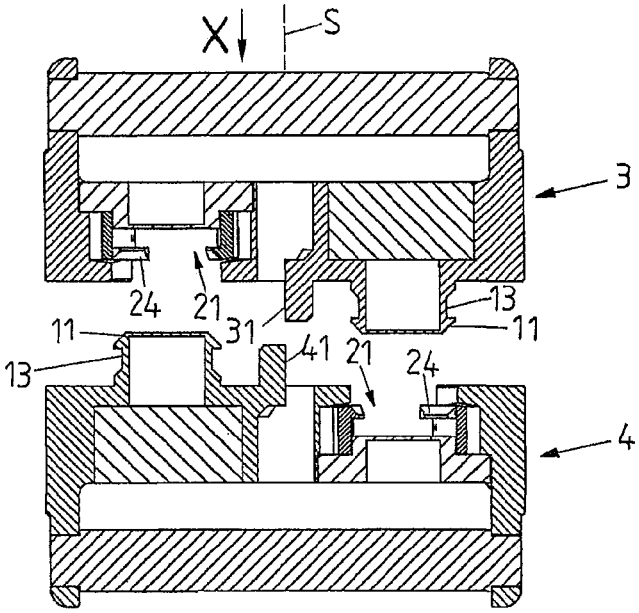
FIG. 19C a sectional view of the closure device along the line A-A according to FIG. 19B.
Figure 19B:
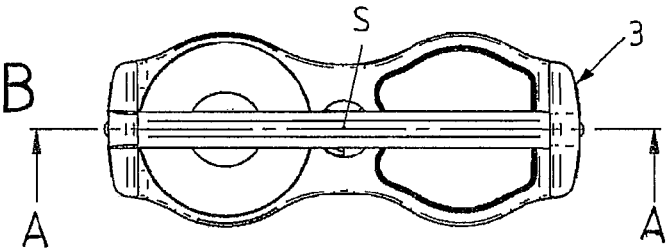
FIG. 19B a top view of the closure device according to FIG. 19A.
Figure 19A:
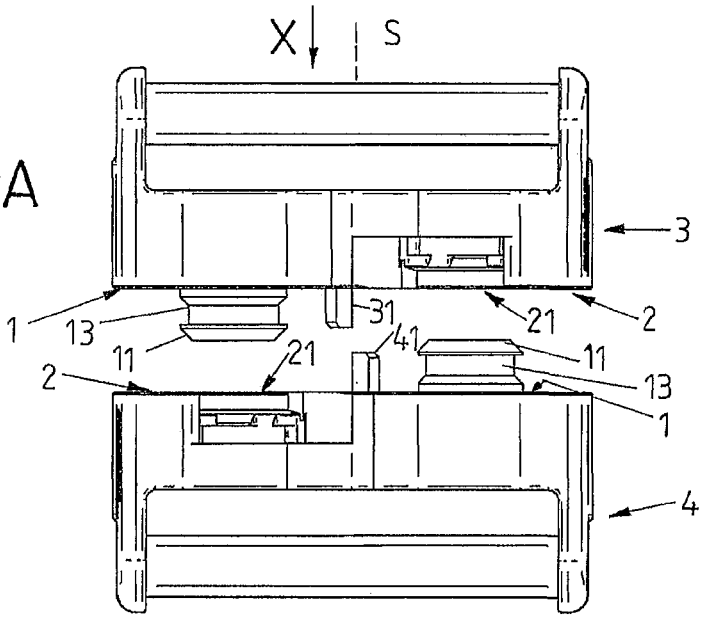
FIG. 19A a side view of a closure device with two closing members having in each case two connecting modules before establishing the closed position.

FIGS. 19A to 19C show the closure device with the closing members 3, 4 before establishing the closed position. The closing members 3, 4 are applied to each other in the closing direction X for closing the closure device so that the connecting modules 1, 2 of the closing members 3, 4 engage in each case with each other and mechanically latch to each other.

Figure 20C:
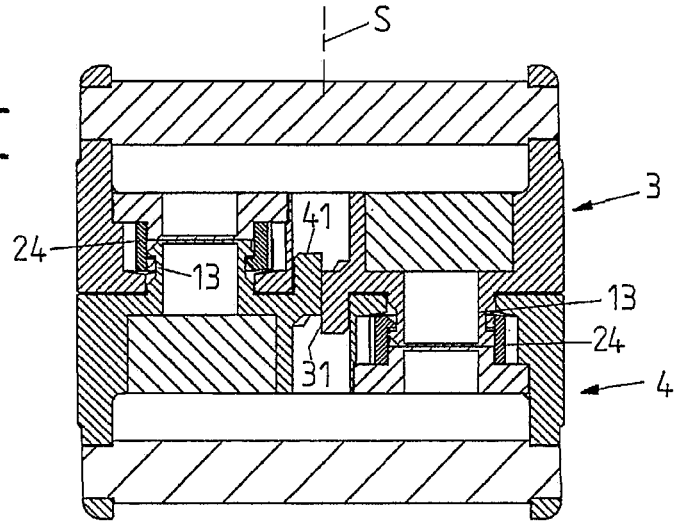
FIG. 20C a sectional view of the closure device along the line A-A according to FIG. 20B.
Figure 20B:
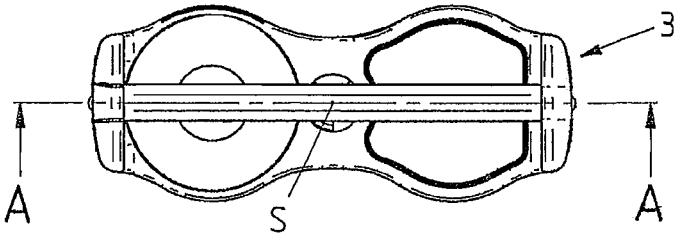
FIG. 20B a top view of the closure device according to FIG. 20A.
Figure 20A:
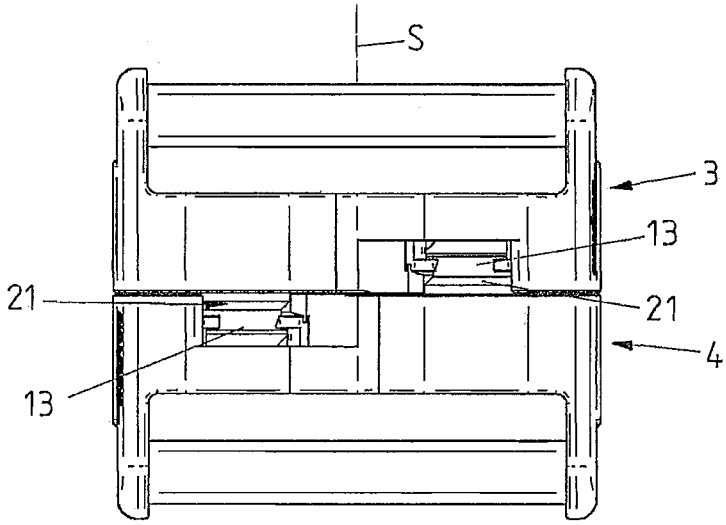
FIG. 20A a side view of the closure device in the closed position.

In the closed position, illustrated in FIGS. 20A to 20C, the blocking pieces 13 engage in each case with the spring locking elements 24 and latch mechanically the closing members 3, 4 to each other.

Figure 21C:
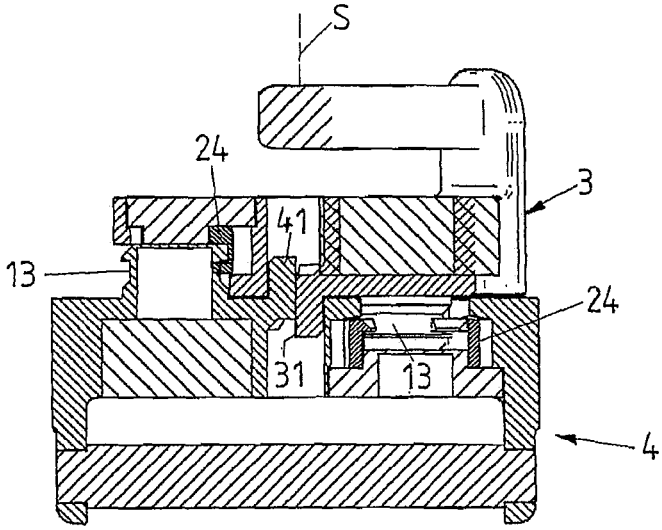
FIG. 21C a side view of the closure device along the line A-A according to FIG. 21B.
Figure 21B:
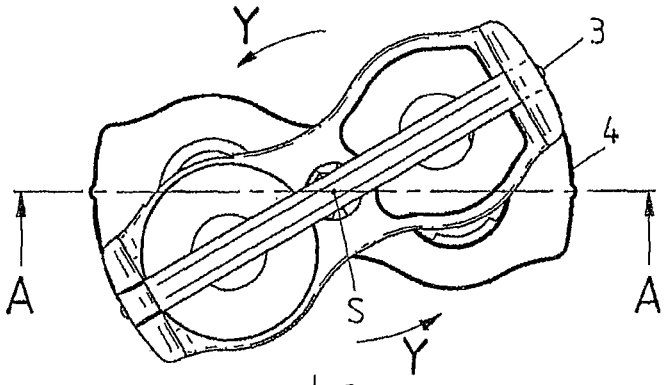
FIG. 21B a top view of the closure device according to FIG. 21A.
Figure 21A:
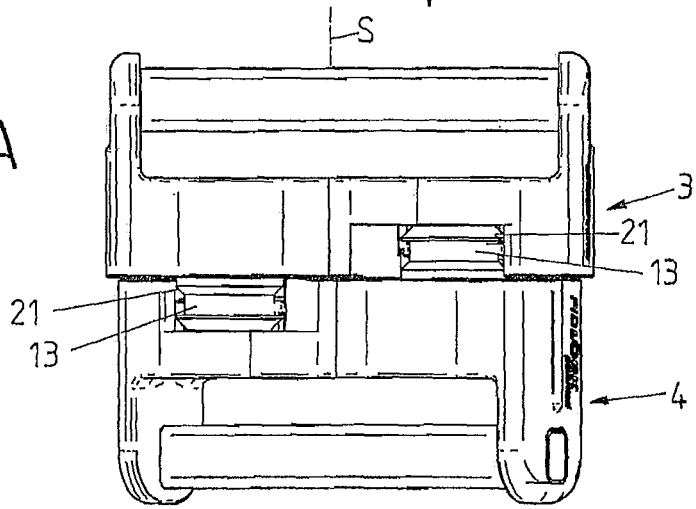
FIG. 21A a side view of the closure device in opened state.
Figure 22B:
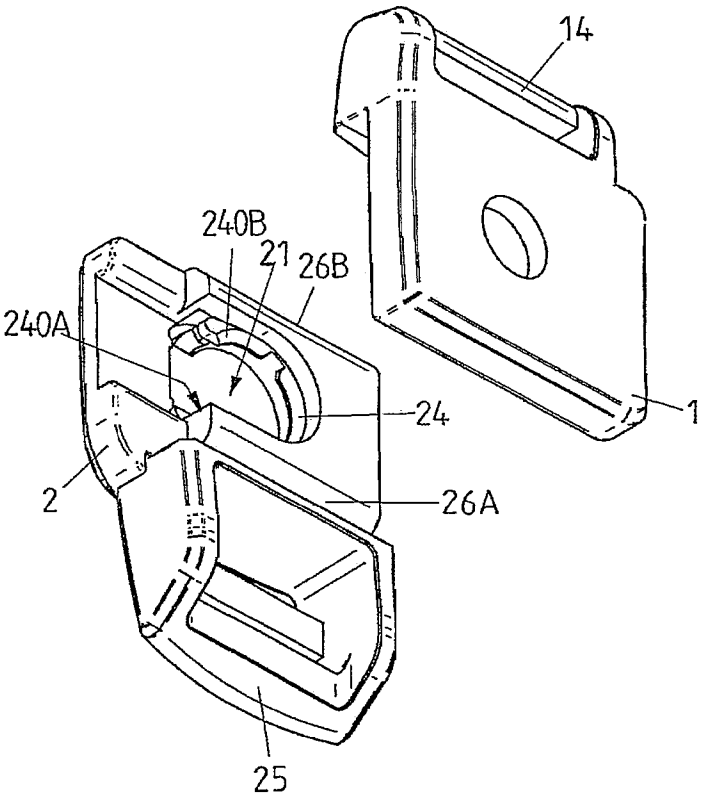
FIGS. 22A, 22B perspective views of a further embodiment of a closure device.
Figure 22A:
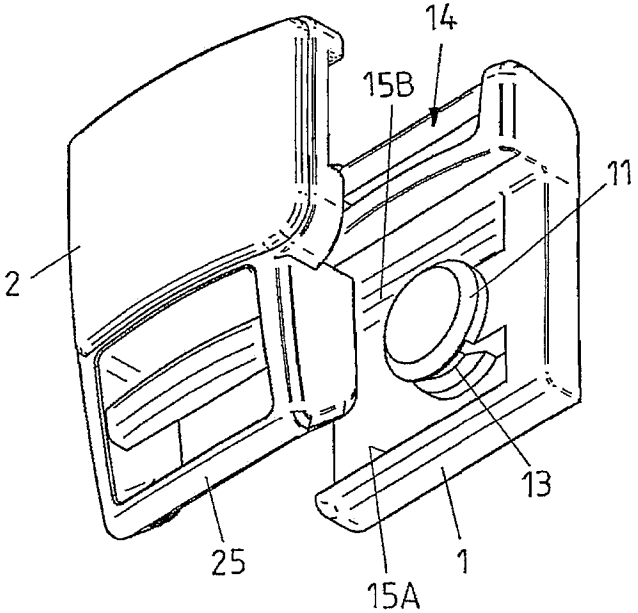
Figure 23A:
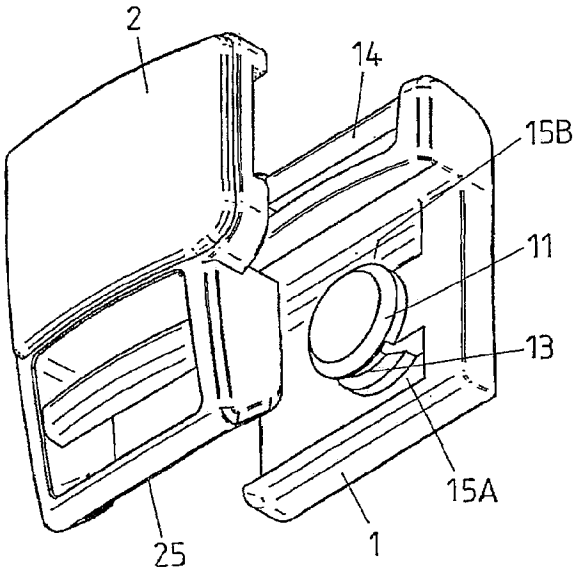
FIG. 23A a perspective view of the closure device before establishing the closed position.
Figure 23B:
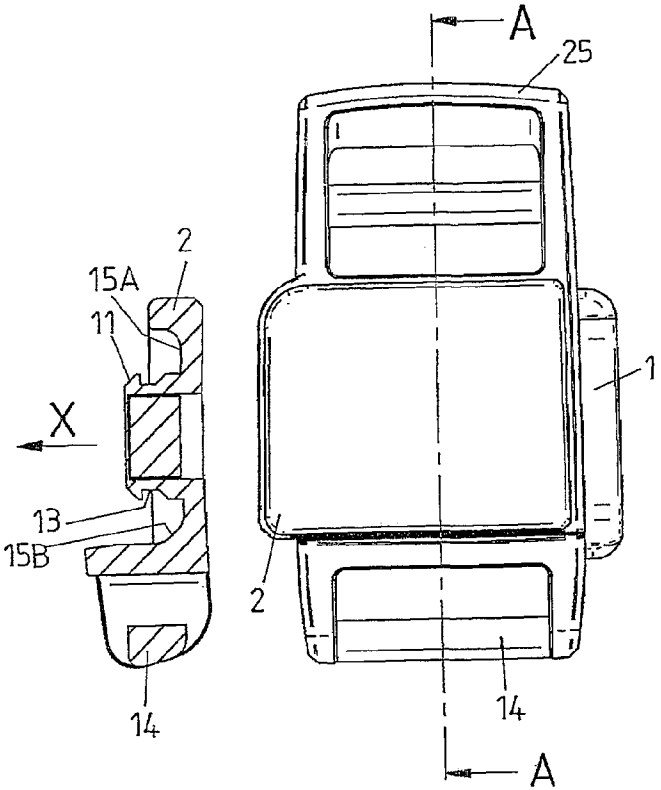
FIG. 23B a top view of the closure device according to FIG. 23A.
Figure 23C:
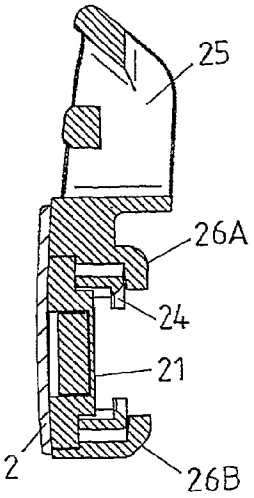
FIG. 23C a sectional view of the closure device along the line A-A according to FIG. 23B.

As illustrated in FIGS. 21A to 21C, the closing members 3, 4 are pivoted to each other for opening about a pivot axis S, which is directed along the symmetrical axis of the closing members 3, 4 parallel to the closing direction X. Through this, the connecting module 1, 2 of the closing members 3, 4 are in each case moved towards each other such that the blocking pieces 13 of the first connecting module 1 are moved in each case in the opening direction Y out of the spring locking elements 24 of the second connecting modules 2. In the opened status the mechanical latching is cancelled and the closing members 3, 4 can be released from each other against the closing direction X.

Figure 18:
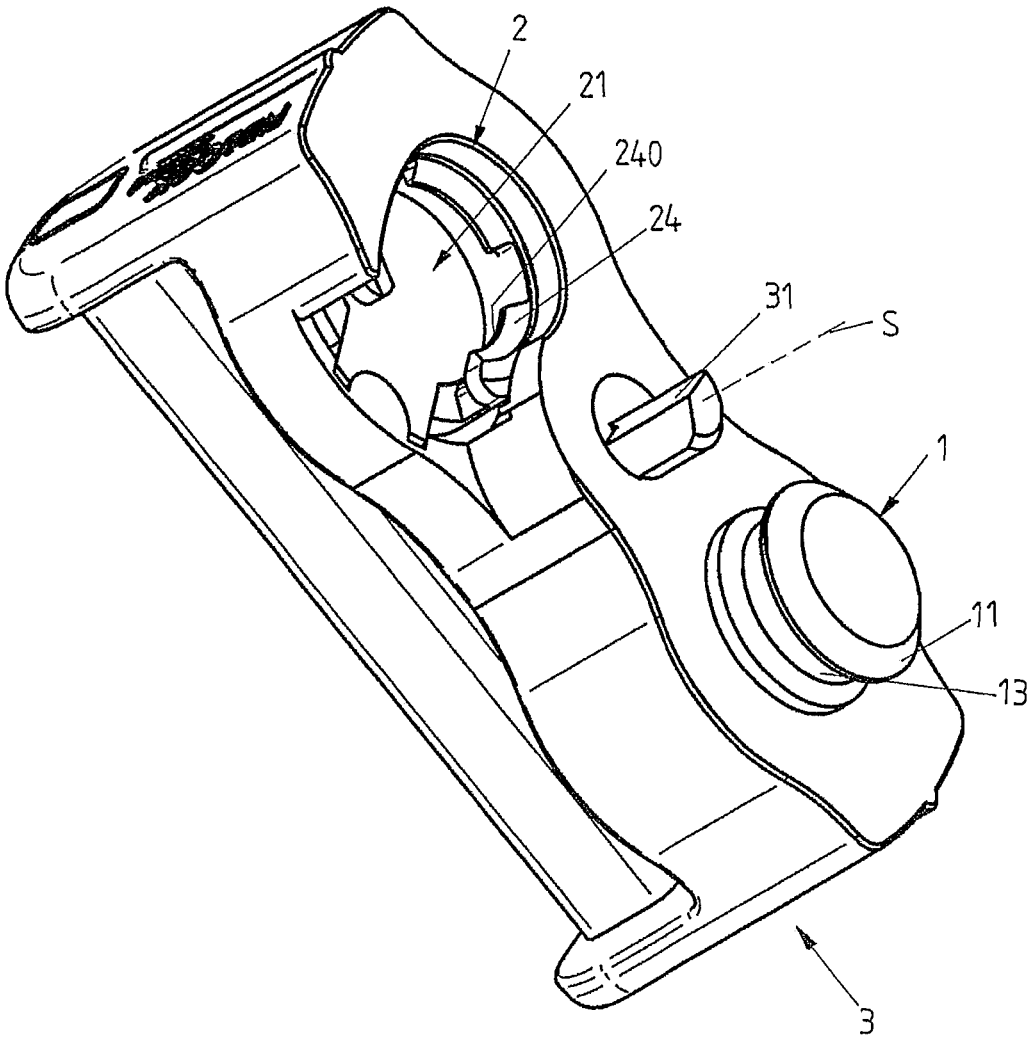
FIG. 18 a perspective view of a closing member of a closure device, in which in each case a first connecting module and a second connecting module are formed on two closing members.

As for instance apparent from FIGS. 18 and 19, a pin 31, 41 is arranged in each case on the closing members 3, 4, which has the form of a circular segment in the cross section and engages in a respective depression on the respective other closing member 3, 4. When transferring the closing members 3, 4 into the closed position (FIGS. 19A to 19C) the pins 31, 41 of the closing members 3, 4 are applied to each other and form thus a physical pivot axis S about which the closing members 3, 4 can be pivoted to each other for opening the closure device as illustrated in FIGS. 21A to 21C.

In order to define the pivot axis S also archlike pivot guidances arranged concentrically to the pivot axis S can be arranged on the first closing member 3 and the second closing member 4 instead of the pins 31, 41 or in addition, wherein said pivot guidances define an archlike guidance about the pivot axis S. In other words, the pivot axis S is not formed as a physical axis but by archlike guidances separated to the pivot axis S.

In modification to the embodiment described by means of FIGS. 18 to 21, it is also conceivable to provide on each closing member 3, 4 more than two connecting modules 1, 2, which are for instance arranged on a circle about the pivot axis S. By pivoting the closing members 3, 4 to each other the connecting modules 1, 2 can then be brought out of their closed position and can be opened in order to release the mechanical latching of the closing members 3, 4 for opening the closure device.

The embodiment of the closure device illustrated in FIGS. 18 to 21 can for instance also be used for connecting belts or ropes, but also for closing bags or caps or such and allows for connection of two components with a secure hold and high transferable loading forces.

FIGS. 22 to 26 show a further embodiment of a closure device. The closure device can be used advantageously for connecting two belts, for instance as a buckle for closing a chin strap of a safety helmet, for instance a ski helmet.

The embodiment of the closure device according to FIGS. 22 to 26 corresponds in its functionality to the closure device according to FIGS. 1 to 7. Accordingly, two connecting modules 1, 2 are provided, which can be applied to each other in a closing direction X for closing the closure device (FIGS. 23A to 23C) and mechanically latched to each other in a closed position via a form fit engagement of a blocking piece 13 and a spring locking element 24 (FIGS. 24A to 24C). The first connecting module 1 can be moved for opening in the opening direction Y relative to the second connecting module 2 (FIGS. 25A to 25C) in order to move in this manner the blocking piece 13 lateral out of the spring locking element 24 (FIGS. 26A to 26C).

A belt connection 14, 25 in form of longitudinal members is provided in each case on the first connecting module 1 and on the second connecting module 2 for connecting two belts, wherein about said longitudinal holms a belt can be laid (looped).

Figure 24A:
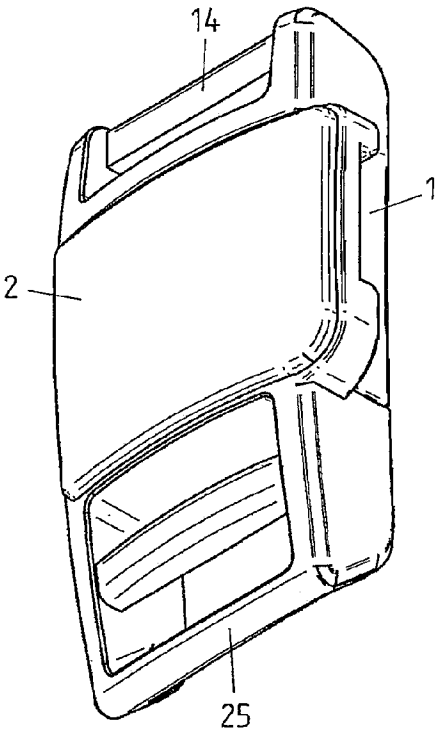
FIG. 24A a perspective view of the closure device in the closed position.
Figure 24B:
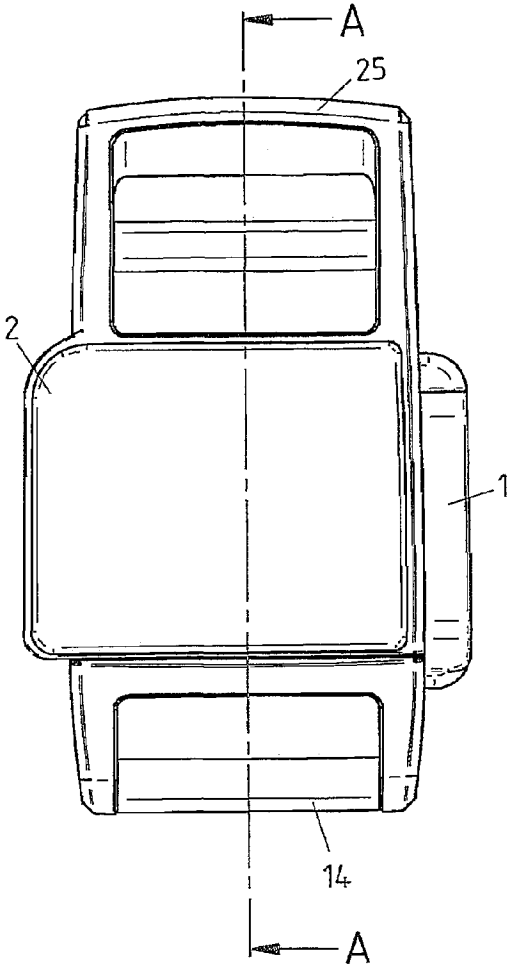
FIG. 24B a top view of the closure device according to FIG. 24A.
Figure 24C:
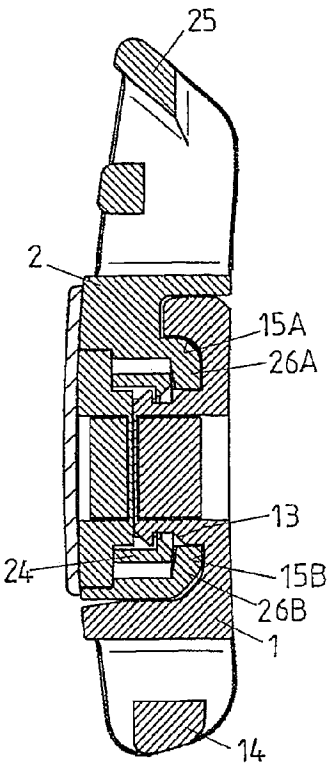
FIG. 24C a sectional view of the closure device along the line A-A according to FIG. 24B.
Figure 25A:
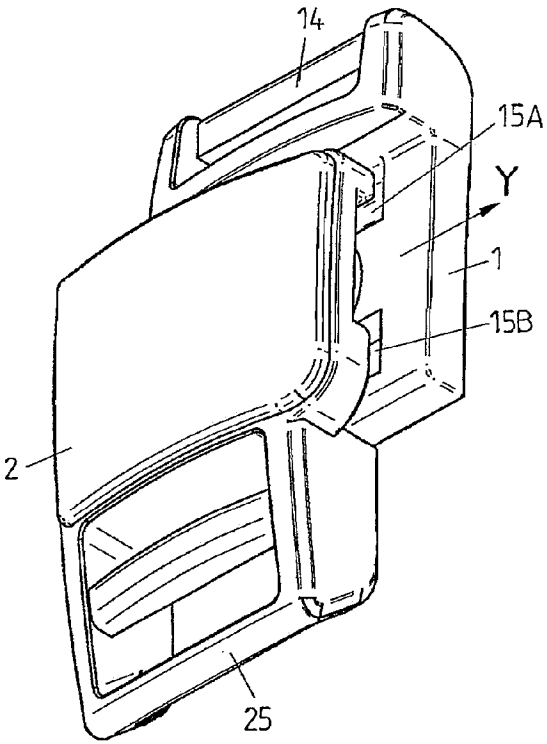
FIG. 25A a perspective view of the closure device during opening.
Figure 25B:
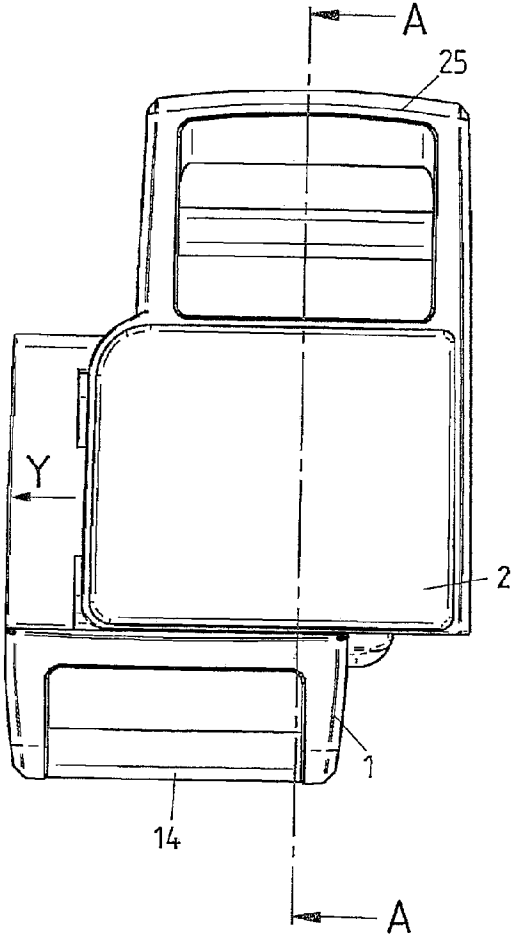
FIG. 25B a top view of the closure device according to FIG. 25A.
Figure 25C:
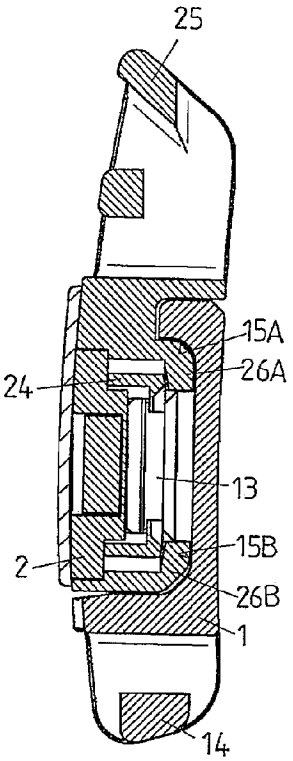
FIG. 25C a sectional view of the closure device along the line A-A according to FIG. 25B.
Figure 26A:
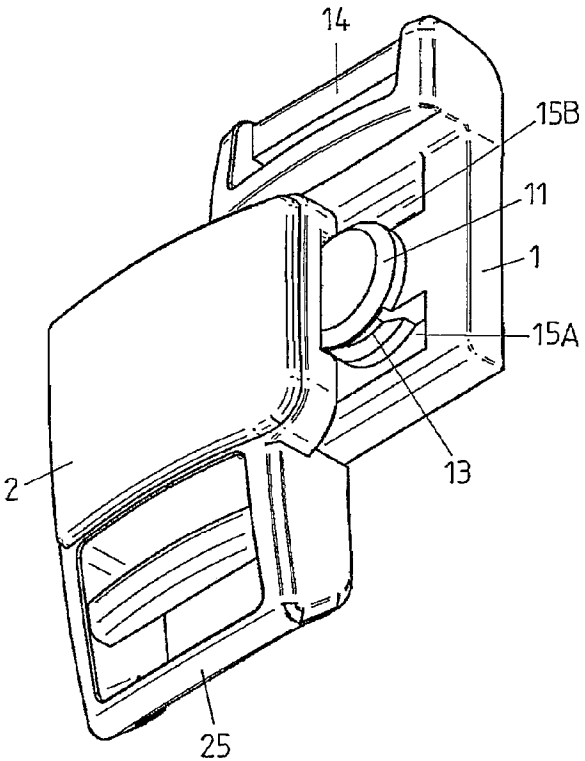
FIG. 26A a perspective view of the closure device in opened state.
Figure 26B:
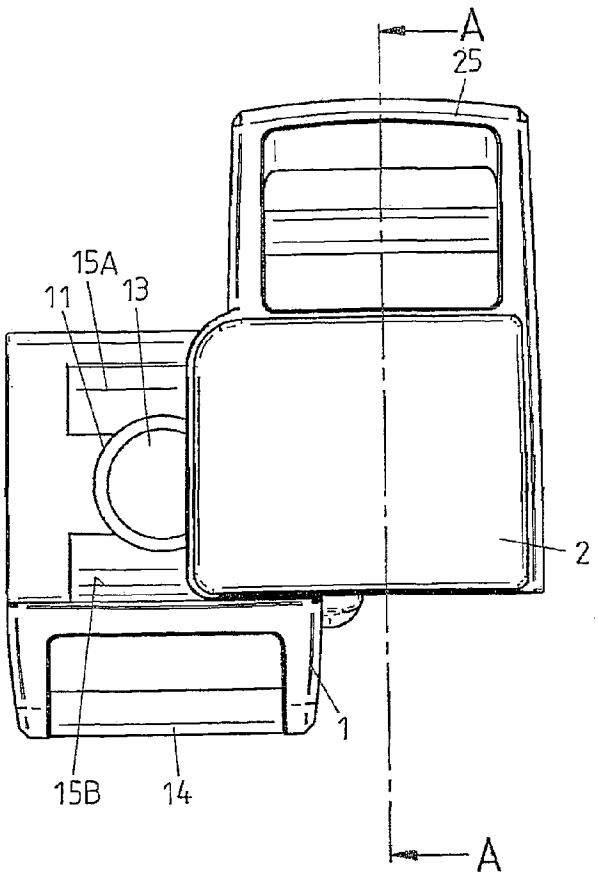
FIG. 26B a top view of the closure device according to FIG. 26A.
Figure 26C:
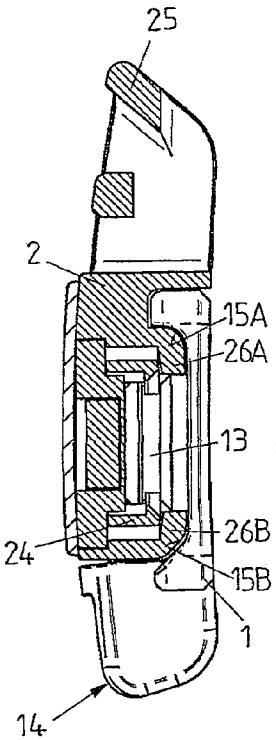
FIG. 26C a sectional view of the closure device along the line A-A according to FIG. 26B.

Two guiding paths are formed lateral to the blocking piece 13 by recesses 15A, 15B on the first connecting module 1, wherein in said guiding paths in the closed position projections 26A, 26B of the second connecting module 2 are placed (FIGS. 24C, 25C). The first connecting module 1 is lateral guided on the second connecting module 2 in the opening direction Y via the recesses 15A, 15B and the projections 26A, 26B so that the opening can occur by a guided movement of the first connecting module 1 relative to the second connecting module in an easy and comfortable manner. The engagement of the projections 26A, 26B into the recess 15A, 15B allows furthermore a secure hold of the closure device by applied belt forces, which affect the belt connections 14, 25 and act cross-wise to the closing directions X and cross-wise to the opening direction Y.

The idea on which the invention is based on is not limited to the previously described embodiment, but can basically also be used in completely different embodiments. In particular, a closure device of the described kind can be used in different areas, for instance for closing of bags, for connecting belts, ropes or such or for coupling other components.

The singular components of the closure device (with the exception of the magnetic means) can be for instance made of plastics.

Instead of a shifting movement it can also be provided to release the first connecting module from the second connecting module by distortion. The opening direction corresponds in this case to a rotational direction, wherein the guiding section is directed with at least one directional vector component against this rotational direction.

LIST OF REFERENCE SIGNS

1 Connecting module
10 Magnet
11 Latching projection
12 Cap
13 Blocking piece
14 Belt connection
15A, 15B Recess
2 Connecting module
20 Magnet
21 Connector holder
210 Connector opening
211 Recess
212 Reach-through opening
22 Recess
23 Base plate
230 Shaping
231 Retaining element
24 Spring ring
240 Latching projection
240A, Guiding section
240B
241 Recess
242, 243 Recess
25 Belt connection
26A, 26B Projection
3, 4 Closing member
31, 41 Pin
α, β Angle
A Misalignment
D Centre axis
F Directional vector
FX, FY Directional vector component
S Pivot direction
V Misalignment
X Closing direction
Y Opening direction

The invention claimed is:

1. A closure device for connecting two parts comprising a first connecting module and a second connecting module, wherein the first connecting module can be arranged on the second connecting module in a closing direction and is mechanically latched with the second connecting module in a closed position, and wherein the first connecting module is releasable from the second connecting module by a movement of the first connecting module or a part of the first connecting module and the second connecting module or a part of the second connecting module relative to each other along an opening direction differing from the closing direction, and magnet device causing a magnetic force of attraction between the first connecting module and the second connecting module for assisting the transfer of the first connecting module into the closed position, wherein the first connecting module comprises a blocking piece and the second connecting module comprises a spring element, the blocking piece and the spring locking element being constituted to establish a mechanical latching between the first connecting module and the second connecting module in the closed position, wherein the blocking piece elastically pushes the spring locking element aside under spring elastic deformation of at least a part of the spring locking element when closing the closure device and in the closed position is in positive locking engagement with the spring locking element, wherein at least one guiding section is arranged on the second connecting module for guiding the first connecting module into the closed position when arranging the first connecting module on the second connecting module, wherein the at least one guiding section is constituted to guide the first connecting module against the opening direction towards the closed position when placing the first connecting module on the second connecting module for closing the closure device.

2. The closure device according to claim 1, wherein the guiding section describes an obtuse angle to the opening direction.

3. The closure device according to claim 1, wherein the spring locking element and the blocking piece can be moved relative to each other for releasing the first connecting module from the second connecting module such that the spring locking element is brought out of engagement with the at least one blocking piece along the opening direction.

4. The closure device according to claim 1, wherein the guiding section is arranged on the spring locking element or a connector holder of a second connecting module.

5. The closure device according to claim 1, wherein the blocking piece of the first connecting module is essentially designed rotationally symmetrically and has a latching projection for mechanically latching with a latching projection of the spring locking element of the second connecting module.

6. The closure device according to claim 5, wherein the spring locking element is designed circular and extends about a centre axis continuing parallel to the closing direction and is arranged on a connector holder of the second connecting module.

7. The closure device according to claim 6, wherein the spring locking element is opened sectionally in circumferential direction for realizing a recess.

8. The closure device according to claim 7, wherein the spring locking element is arranged torque-proofed on a connector holder of the second connecting module, wherein the recess is arranged in opening direction if looked at from the centre axis.

9. The closure device according to claim 7, wherein the spring locking element is arranged rotatably on the connector holder of the second connecting module, wherein the spring locking element can be rotated about the centre axis for releasing the first connecting module from the second connecting module in order to arrange the recess in the opening direction if looked at from the centre axis.

10. The closure device according to claim 9, wherein a lever for rotating the spring locking element is arranged on the spring locking element.

11. The closure device according to claim 1, wherein the blocking piece of the first connecting module extends essentially in a lateral direction with an angle to the closing direction and has a latching projection for mechanically latching with a latching projection of the spring locking element of the second connecting module.

12. The closure device according to claim 1, wherein the spring locking element encompasses in the locking position the blocking piece circumferentially such that a spring force of the spring locking element has to be overcome for releasing the connecting modules from each other.

13. The closure device according to claim 1, wherein the magnetic means are formed by a magnet arranged in each case on the first connecting module and the second connecting module or are formed by a magnet on one side and a magnetic anchor on the other side.

14. The closure device according to claim 1, wherein the magnetic means are designed such that the magnetic attraction force between the first connecting module and the second connecting module is weakened by the movement of the first connecting module in the opening direction.

15. The closure device according to claim 1, comprising a first closing member and a second closing member, which can be placed on each other in the closing direction and of which one comprises two first connecting modules and the other comprises two second connecting modules or which comprise in each case one first connecting module and one second connecting module.

16. The closure device according to claim 15, wherein the first closing member and the second closing member are locked mechanically to each other in the closed position via the respective two connecting modules arranged on the closing members, wherein the closing members are pivotably towards each other about a pivot axis for opening the closure device in order thus to move the connecting modules of the closing members relative to each other for opening.

17. The closure device according to claim 15, wherein the first closing member and the second closing member are identical in construction.

18. The closure device according to claim 1, further including another first connecting module and another second connecting module which can be applied to each other in the closing direction.

* * * * *

UNITED STATES PATENT AND TRADEMARK OFFICE

CERTIFICATE OF CORRECTION

PATENT NO. : 8,794,682 B2
APPLICATION NO. : 13/145609
DATED : August 5, 2014
INVENTOR(S) : Joachim Fiedler It is certified that error appears in the above-identified patent and that said Letters Patent is hereby corrected as shown below:

In the Claims,

Column 16, Line 28, Claim 1, before “magnet” insert -- a --

Column 16, Line 34, Claim 1, after “spring” insert -- locking -- (First occurrence)

Signed and Sealed this
Sixteenth Day of December, 2014

Michelle K. Lee

Michelle K. Lee
*Deputy Director of the United States Patent and Trademark Office*